US012145711B2

(12) United States Patent
Itou

(10) Patent No.: US 12,145,711 B2
(45) Date of Patent: Nov. 19, 2024

(54) SYSTEM AND METHOD FOR CONTROLLING OUTBOARD MOTOR

(71) Applicant: YAMAHA HATSUDOKI KABUSHIKI KAISHA, Iwata (JP)

(72) Inventor: Yasutaka Itou, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 593 days.

(21) Appl. No.: 17/403,919

(22) Filed: Aug. 17, 2021

(65) Prior Publication Data

US 2022/0106029 A1 Apr. 7, 2022

(30) Foreign Application Priority Data

Oct. 2, 2020 (JP) ..... 2020-168026

(51) Int. Cl.

| | |
|---|---|
| ***B63H 25/42*** | (2006.01) |
| ***B63H 20/12*** | (2006.01) |
| ***B63H 25/04*** | (2006.01) |
| *B63H 20/00* | (2006.01) |
| *B63H 25/02* | (2006.01) |

(52) U.S. Cl.

CPC ..... *B63H 25/42* (2013.01); *B63H 20/12* (2013.01); *B63H 25/04* (2013.01); *B63H 2020/003* (2013.01); *B63H 2025/022* (2013.01); *B63H 2025/026* (2013.01); *B63H 2025/028* (2013.01)

(58) Field of Classification Search

CPC ..... B63H 25/42; B63H 20/12; B63H 25/04; B63H 2020/003; B63H 2025/022; B63H 2025/026; B63H 2025/028; B63H 20/32; B63B 45/00

See application file for complete search history.

(56) References Cited

U.S. PATENT DOCUMENTS

| | | | | |
|---|---|---|---|---|
| 10,000,268 | B1 * | 6/2018 | Poirier | H01H 25/04 |
| 10,336,427 | B1 * | 7/2019 | Ichikawa | F02D 11/106 |
| 2016/0236757 | A1 * | 8/2016 | Davis | F21S 43/30 |
| 2022/0194538 | A1 * | 6/2022 | Tao | B63H 20/007 |

FOREIGN PATENT DOCUMENTS

| | | | |
|---|---|---|---|
| JP | 2008247102 A | * | 10/2008 |
| JP | 2019-137278 A | | 8/2019 |

OTHER PUBLICATIONS

JP-2008247102 English Translate (Year: 2024).*

* cited by examiner

*Primary Examiner* — Jelani A Smith
*Assistant Examiner* — Paul A Castro
(74) *Attorney, Agent, or Firm* — Keating & Bennett, LLP

(57) ABSTRACT

A system for controlling an outboard motor attached to a boat includes an input, a light unit, and a controller. The input is operable by an operator to select a control mode of the outboard motor. The light unit includes a plurality of light sources. The controller is connected to the input and the light unit. The controller controls the outboard motor according to the control mode. The controller controls the light unit to light the plurality of light sources in a pattern indicating a movement of the boat according to the control mode.

22 Claims, 28 Drawing Sheets

SYSTEM AND METHOD FOR CONTROLLING OUTBOARD MOTOR

CROSS REFERENCE TO RELATED APPLICATIONS

This application claims the benefit of priority to Japanese Patent Application No. 2020-168026 filed on Oct. 2, 2020. The entire contents of this application are hereby incorporated herein by reference.

BACKGROUND OF THE INVENTION

1. Field of the Invention

The present invention relates to a system and a method for controlling an outboard motor.

2. Description of the Related Art

Conventionally, a system for controlling an outboard motor according to a selected control mode is known. For example, in Japanese Patent Application Laid-Open No. 2019-137278, when the fixed point holding mode is selected by the mode setting switch, the controller executes the fixed point holding mode. In the fixed point holding mode, the controller controls the outboard motor to hold the boat in place.

SUMMARY OF THE INVENTION

Preferred embodiments of the present invention provide systems and methods for controlling outboard motors according to a selected control mode.

A system according to a first preferred embodiment of the present invention controls an outboard motor attached to a boat. The system includes an input, a light unit, and a controller. The input is operable by an operator to select a control mode of the outboard motor. The light unit includes a plurality of light sources. The controller is connected to the input and the light unit. The controller is configured or programmed to control the outboard motor according to the control mode. The controller is configured or programmed to control the light unit to light at least a portion of the plurality of light sources in a pattern indicating a movement of the boat according to the control mode.

A method according to a second preferred embodiment of the present invention controls an outboard motor. The outboard motor includes a light unit including a plurality of light sources and is attached to the boat. The method includes receiving a signal indicative of a control mode of the outboard motor, controlling the outboard motor according to the control mode, and controlling the light unit to light at least a portion of the plurality of light sources in a pattern indicating a movement of the boat according to the control mode.

The above and other elements, features, steps, characteristics and advantages of the present invention will become more apparent from the following detailed description of the preferred embodiments with reference to the attached drawings.

DETAILED DESCRIPTION OF THE REFERRED EMBODIMENTS

Figure 1:
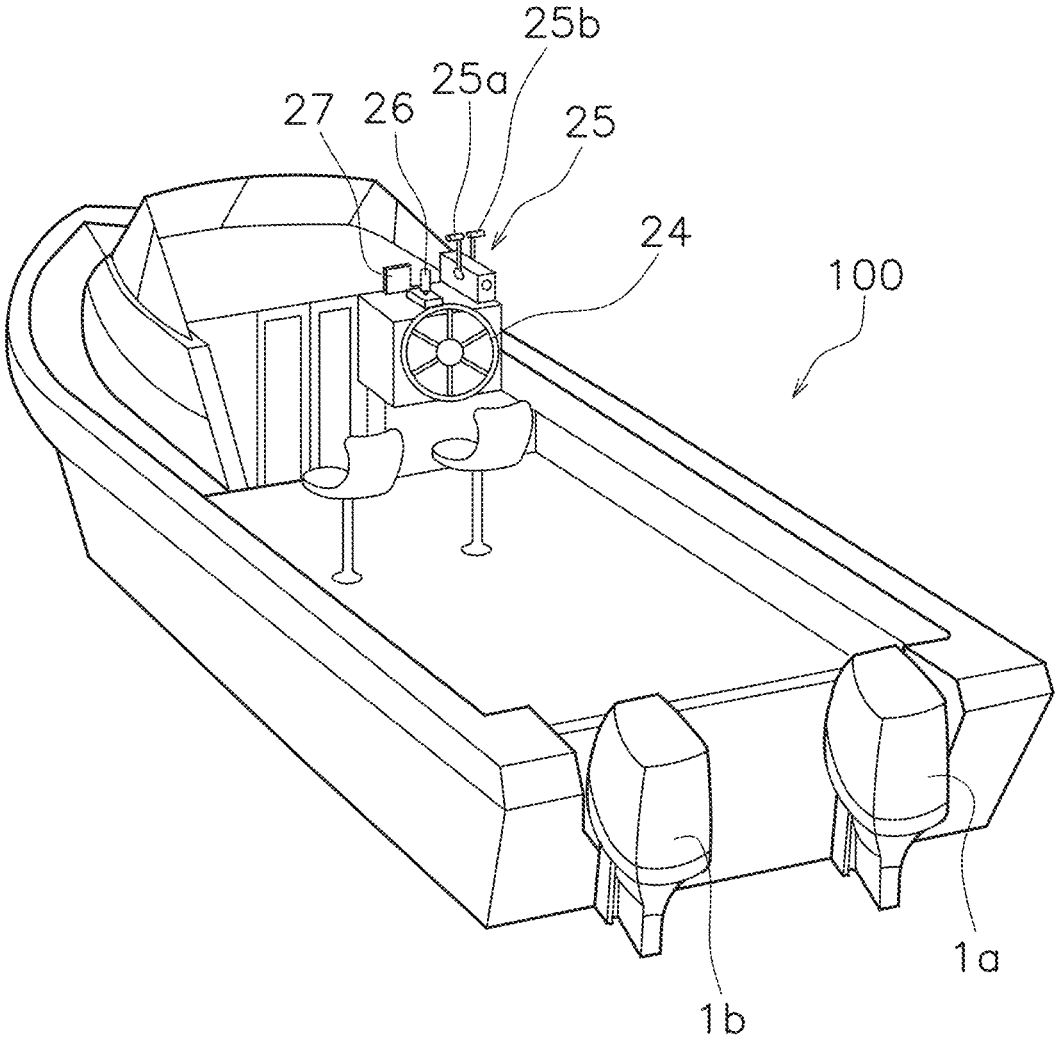
FIG. 1 is a perspective view showing a boat equipped with an outboard motor according to a first preferred embodiment of the present invention.

Hereinafter, preferred embodiments will be described with reference to the drawings. FIG. 1 is a perspective view showing a boat 100 equipped with an outboard motor according to a first preferred embodiment of the present invention. The boat 100 includes a plurality of outboard motors 1*a* and 1*b*.

The outboard motors 1*a* and 1*b* are attached to a stern of the boat 100. The outboard motors 1*a* and 1*b* are arranged side by side in a width direction of the boat 100. Specifically, the outboard motor 1*a* is located on a port side of the boat 100. The outboard motor 1*b* is located on a starboard side of the boat 100. The outboard motors 1*a* and 1*b* generate thrusts that propel the boat 100, respectively.

Figure 2:
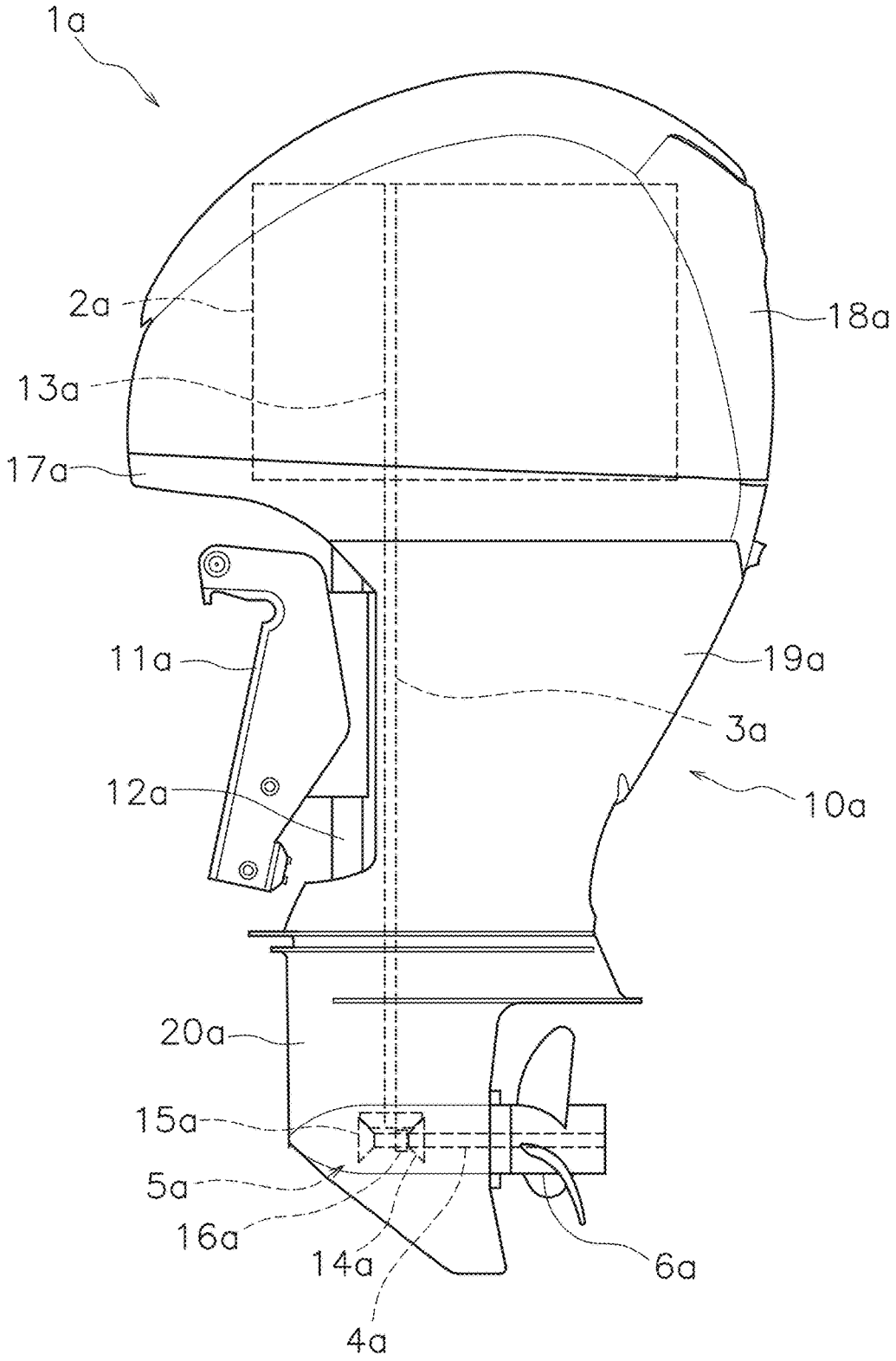
FIG. 2 is a side view of the outboard motor.

FIG. 2 is a side view of the outboard motor 1*a*. Hereinafter, the structure of the outboard motor 1*a* will be described, but the outboard motor 1*b* has the same structure as that of the outboard motor 1*a*. The outboard motor 1*a* is attached to the boat 100 via a bracket 11*a*. The bracket 11*a* rotatably supports the outboard motor 1*a* around a steering shaft 12*a*. The steering shaft 12*a* extends in a vertical direction of the outboard motor 1*a*.

In the present preferred embodiment, the direction in which the bracket 11*a* is provided in the outboard motor 1*a* is defined as a forward direction, and the opposite direction is defined as a rearward direction. That is, the direction from the outboard motor 1*a* to the boat 100 is defined as the forward direction, and the direction from the boat 100 to the outboard motor 1*a* is defined as the rearward direction.

The outboard motor 1*a* includes a drive unit 2*a*, a drive shaft 3*a*, a propeller shaft 4*a*, and a shift mechanism 5*a*. The drive unit 2*a* generates a thrust that propels the boat 100. The drive unit 2*a* is an internal combustion engine, for example. The drive unit 2*a* includes a crankshaft 13*a*. The crankshaft 13*a* extends in the vertical direction of the outboard motor 1*a*. The drive shaft 3*a* is connected to the crankshaft 13*a*. The drive shaft 3*a* extends in the vertical direction of the outboard motor 1*a*. The propeller shaft 4*a* extends in a front-rear direction of the outboard motor 1*a*. The propeller shaft 4*a* is connected to the drive shaft 3*a* via the shift mechanism 5*a*. A propeller 6*a* is attached to the propeller shaft 4*a*.

The shift mechanism 5*a* includes a forward gear 14*a*, a reverse gear 15*a*, and a dog clutch 16*a*. By switching the connection of the gears 14*a* and 15*a* by the dog clutch 16*a*, the transmission direction of rotation from the drive shaft 3*a* to the propeller shaft 4*a* is switched. As a result, the forward movement and the reverse movement of the boat 100 are switched.

The outboard motor 1*a* includes a housing 10*a*. The housing 10*a* houses the drive unit 2*a*, the drive shaft 3*a*, the propeller shaft 4*a*, and the shift mechanism 5*a*. The housing 10*a* includes a bottom cowl 17*a*, a top cowl 18*a*, an upper case 19*a*, and a lower case 20*a*. The bottom cowl 17*a* supports the drive unit 2*a*. The bottom cowl 17*a* is made of resin, for example. However, the bottom cowl 17*a* may be made of metal such as aluminum. The top cowl 18*a* is located above the bottom cowl 17*a*. The top cowl 18*a* is attached to the bottom cowl 17*a*. The upper case 19*a* is located below the bottom cowl 17*a*. The lower case 20*a* is located below the upper case 19*a*. The lower case 20*a* houses the propeller shaft 4*a* and the shift mechanism 5*a*.

Figure 3:
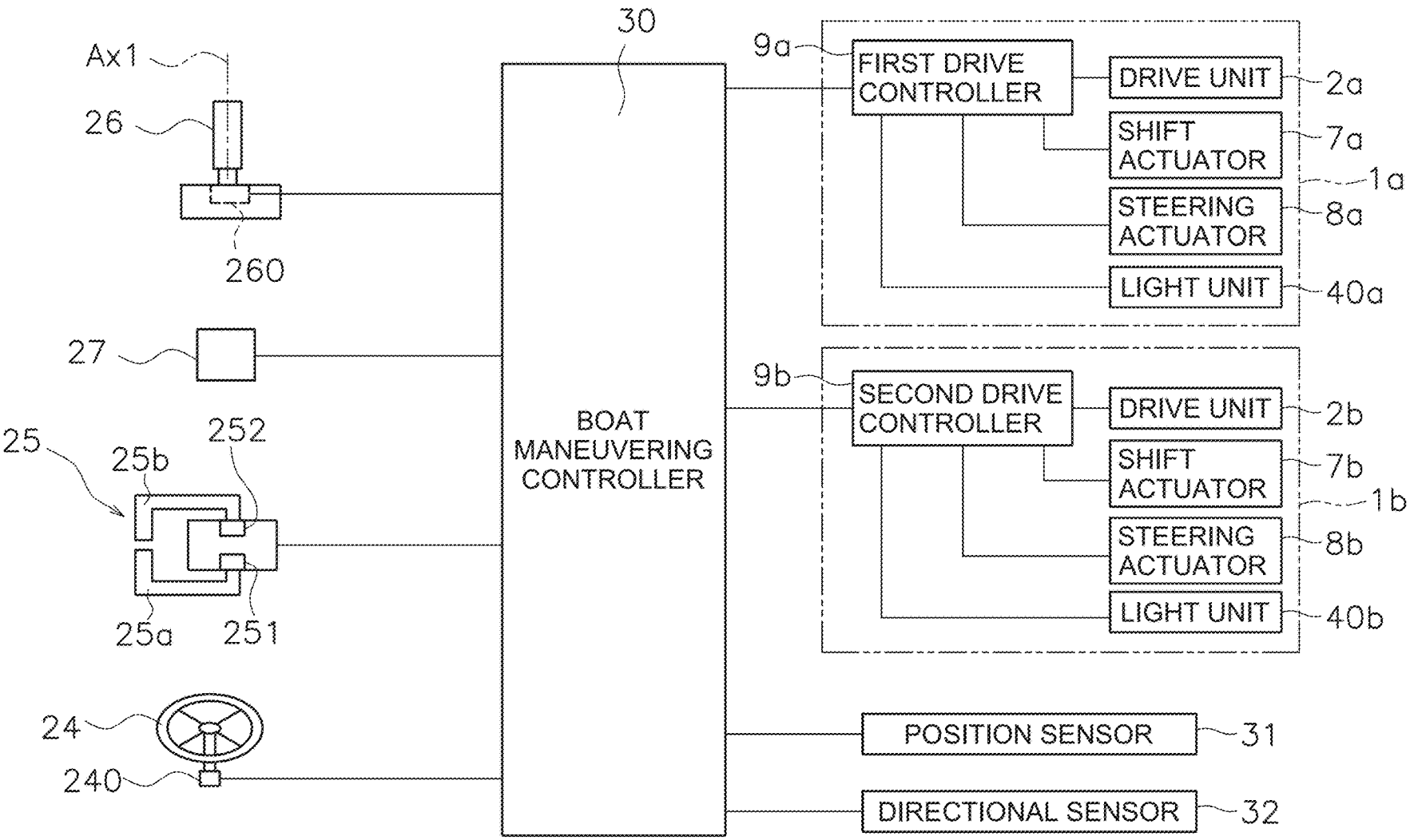
FIG. 3 is a schematic view showing a configuration of a boat maneuvering system.

FIG. 3 is a schematic view showing a configuration of a boat maneuvering system of the boat 100. As illustrated in FIG. 3, the outboard motor 1*a* includes a shift actuator 7*a* and a steering actuator 8*a*.

The shift actuator 7*a* is connected to the dog clutch 16*a* of the shift mechanism 5*a*. The shift actuator 7*a* switches the connection of the gears 14*a* and 15*a* by operating the dog clutch 16*a*. As a result, the forward movement and the reverse movement of the boat 100 are switched. The shift actuator 7*a* is, for example, an electric motor. However, the shift actuator 7*a* may be another actuator such as an electric cylinder, a hydraulic motor, or a hydraulic cylinder.

The steering actuator 8*a* is connected to the outboard motor 1*a*. The steering actuator 8*a* rotates the outboard motor 1*a* around the steering shaft 12*a*. As a result, a steering angle of the outboard motor 1*a* is changed. The steering angle is an angle of the propeller shaft 4*a* with respect to the front-rear direction of the outboard motor 1*a*. The steering actuator 8*a* is, for example, an electric motor. However, the shift actuator 7*a* may be another actuator such as an electric cylinder, a hydraulic motor, or a hydraulic cylinder.

The outboard motor 1*a* includes a first drive controller 9*a*. The first drive controller 9*a* includes a processor such as a CPU and a memory such as a RAM or a ROM. The first drive controller 9*a* stores programs and data to control the outboard motor 1*a*. The first drive controller 9*a* controls the drive unit 2*a*.

The outboard motor 1*b* includes a drive unit 2*b*, a shift actuator 7*b*, a steering actuator 8*b*, and a second drive controller 9*b*. The drive unit 2*b*, the shift actuator 7*b*, the steering actuator 8*b*, and the second drive controller 9*b* of the outboard motor 1*b* are the same as the drive unit 2*a*, the shift actuator 7*a*, the steering actuator 8*a*, and the first drive controller 9*a* of the outboard motor 1*a*, respectively.

The boat maneuvering system includes a steering wheel 24, a remote controller 25, a joystick 26, and an input device 27. As illustrated in FIG. 1, the steering wheel 24, the remote controller 25, the joystick 26, and the input device 27 are located in a cockpit of the boat 100.

The steering wheel 24 enables an operator to operate a turning direction of the boat 100. The steering wheel 24 includes a sensor 240. The sensor 240 outputs a steering signal indicative of an operating direction and an operating amount of the steering wheel 24.

The remote controller 25 includes a first throttle lever 25*a* and a second throttle lever 25*b*. The first throttle lever 25*a* enables the operator to adjust a magnitude of the thrust of the outboard motor 1*a*. Further, the first throttle lever 25*a* enables the operator to switch a direction of the thrust of the outboard motor 1*a* between forward and reverse. The first throttle lever 25*a* is operable from a neutral position in a forward direction and in a reverse direction. The neutral position is between the forward direction and the reverse direction. The first throttle lever 25*a* includes a sensor 251. The sensor 251 outputs a throttle signal indicative of an operating direction and an operating amount of the first throttle lever 25*a*.

The second throttle lever 25*b* enables the operator to adjust a magnitude of the thrust of the outboard motor 1*b*. The second throttle lever 25*b* enables the operator to switch a direction of the thrust of the outboard motor 1*b* between forward and reverse. The configuration of the second throttle lever 25*b* is the same as that of the first throttle lever 25*a*. The second throttle lever 25*b* includes a sensor 252. The sensor 252 outputs a throttle signal indicative of an operating direction and an operating amount of the second throttle lever 25*b*.

The joystick 26 enables the operator to operate a moving direction of the boat 100 in each of the forward, rearward, left, and right directions. The joystick 26 enables the operator to operate a pivot turning operation of the boat 100. The joystick 26 is able to be tilted from a neutral position in at least four directions of forward, rearward, left, and right. The joystick 26 may be tilted in four or more directions, or may be tilted in all directions. The joystick 26 is able to rotate about the rotation axis Ax1. That is, the joystick 26 is able to be twisted clockwise and counterclockwise from a center position around the rotation axis Ax1.

The joystick 26 includes a sensor 260. The sensor 260 outputs a joystick signal indicative of an operation of the joystick 26. The joystick signal includes a tilting direction and a tilting amount of the joystick 26. The joystick signal includes a twisting direction and a twisting amount of the joystick 26.

The boat maneuvering system includes a boat maneuvering controller 30. The boat maneuvering controller 30 includes a processor such as a CPU and a memory such as a RAM or a ROM. The boat maneuvering controller 30 stores programs and data to control the outboard motor 1*a* and the outboard motor 1*b*. The boat maneuvering controller 30 is connected to the first and second drive controllers 9*a* and 9*b* via a wire or wirelessly. The boat maneuvering controller 30 is connected to the steering wheel 24, the remote controller 25, the joystick 26, and the input device 27 via the first and second drive controllers 9*a* and 9*b*.

The boat maneuvering controller 30 receives the steering signal from the sensor 240. The boat maneuvering controller 30 receives the throttle signal from the sensors 251 and 252. The boat maneuvering controller 30 receives the joystick signal from the sensor 260. The boat maneuvering controller 30 outputs command signals to the first and second drive controllers 9*a* and 9*b* based on the signals from the sensors 240, 251, 252, and 260. The command signals are transmitted to the shift actuators 7*a* and 7*b* and the steering actuators 8*a* and 8*b* via the first and second drive controllers 9*a* and 9*b*.

For example, the boat maneuvering controller 30 outputs a command signal to the shift actuator 7*a* according to the operating direction of the first throttle lever 25*a*. As a result, the outboard motor 1*a* is switched between forward and reverse. The boat maneuvering controller 30 outputs a throttle command to the drive unit 2*a* according to the operating amount of the first throttle lever 25*a*. The first drive controller 9*a* controls the output rotation speed of the outboard motor 1*a* in response to the throttle command.

The boat maneuvering controller 30 outputs a command signal to the shift actuator 7*b* according to the operating direction of the second throttle lever 25*b*. As a result, the outboard motor 1*b* is switched between forward and reverse. The boat maneuvering controller 30 outputs a throttle command to the drive unit 2*b* according to the operating amount of the second throttle lever 25*b*. The second drive controller 9*b* controls the output rotation speed of the outboard motor 1*b* in response to the throttle command.

The boat maneuvering controller 30 outputs a command signal to the steering actuators 8*a* and 8*b* according to the operating direction and the operating amount of the steering wheel 24. When the steering wheel 24 is operated from the neutral position to the left, the boat maneuvering controller 30 controls the steering actuators 8*a* and 8*b* so as to rotate the outboard motor 1*a* and the outboard motor 1*b* to the right. As a result, the boat 100 turns to the left.

When the steering wheel 24 is operated from the neutral position to the right, the boat maneuvering controller 30 controls the steering actuators 8*a* and 8*b* so as to rotate the outboard motor 1*a* and the outboard motor 1*b* to the left. As a result, the boat 100 turns to the right. Further, the boat maneuvering controller 30 controls the steering angles of the outboard motor 1*a* and the outboard motor 1*b* according to the operating amount of the steering wheel 24.

The boat maneuvering controller 30 outputs command signals to the drive units 2*a* and 2*b*, the shift actuators 7*a* and 7*b*, and the steering actuators 8*a* and 8*b* according to the tilting direction and the tilting amount of the joystick 26. The boat maneuvering controller 30 controls the drive units 2*a* and 2*b*, the shift actuators 7*a* and 7*b*, and the steering actuators 8*a* and 8*b* so as to translate the boat 100 in a direction corresponding to the tilting direction of the joystick 26 at a speed corresponding to the tilting amount.

When the joystick 26 is tilted forward, the boat maneuvering controller 30 moves the boat 100 forward (forward movement mode). When the joystick 26 is tilted rearward, the boat maneuvering controller 30 moves the boat 100 rearward (rearward movement mode).

Figure 4:
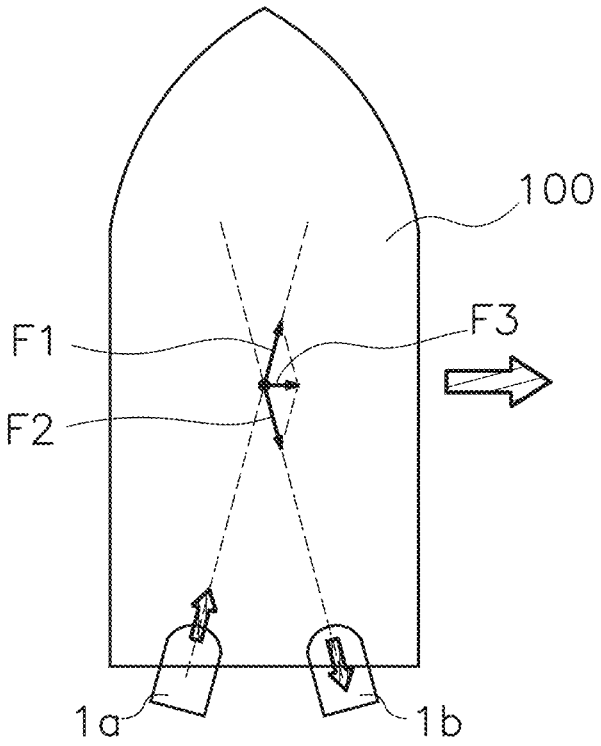
FIG. 4 is a schematic view showing a control of the outboard motor.

When the joystick 26 is tilted to the left or right, the boat maneuvering controller 30 laterally moves the boat 100 to the left or right (lateral movement mode). For example, when the joystick 26 is tilted to the right, as illustrated in FIG. 4, the boat maneuvering controller 30 controls the thrusts and steering angles of the outboard motors 1*a* and 1*b* so that a resultant force F3 of the thrust F1 of the outboard motor 1*a* and the thrust F2 of the outboard motor 1*b* face to the right of the boat 100. Although not illustrated, when the joystick 26 is tilted to the left, the boat maneuvering controller 30 controls the thrusts and the steering angles of the outboard motors 1*a* and 1*b* so that the resultant force F3 of the thrust F1 of the outboard motor 1*a* and the thrust F2 of the outboard motor 1*b* face to the left of the boat 100.

The boat maneuvering controller 30 controls the drive units 2*a* and 2*b*, the shift actuators 7*a* and 7*b*, and the steering actuators 8*a* and 8*b* so that the boat 100 pivots in a direction corresponding to the twisting direction of the joystick 26 and at a speed corresponding to the twisting amount (pivot turning mode). For example, the boat maneuvering controller 30 generates forward thrust in one of the outboard motor 1*a* and the outboard motor 1*b*, and generates reverse thrust in the other of the outboard motor 1*a* and the outboard motor 1*b* to pivot the boat 100.

The boat maneuvering system includes a position sensor 31. The position sensor 31 detects a position of the boat 100. The position sensor 31 is a receiver of a GNSS (Global Navigation Satellite System) such as a GPS (Global Positioning System). However, the position sensor 31 may be a sensor other than the GNSS receiver. The position sensor 31 outputs a signal indicative of the position of the boat 100. The boat maneuvering controller 30 is communicably connected to the position sensor 31. The boat maneuvering controller 30 acquires the position of the boat 100 due to the signal from the position sensor 31. Further, the boat maneuvering controller 30 acquires a speed of the boat 100 due to the signal from the position sensor 31. The maneuvering system may include a separate sensor to detect the speed of the boat 100.

The boat maneuvering system includes a directional sensor 32. The directional sensor 32 detects a course of the boat 100. The directional sensor 32 is, for example, an IMU (Inertial Measurement Unit). However, the directional sensor 32 may be a sensor other than the IMU. The boat maneuvering controller 30 is communicably connected to the directional sensor 32. The boat maneuvering controller 30 acquires the course of the boat 100 from the signal from the directional sensor 32.

Figure 5:
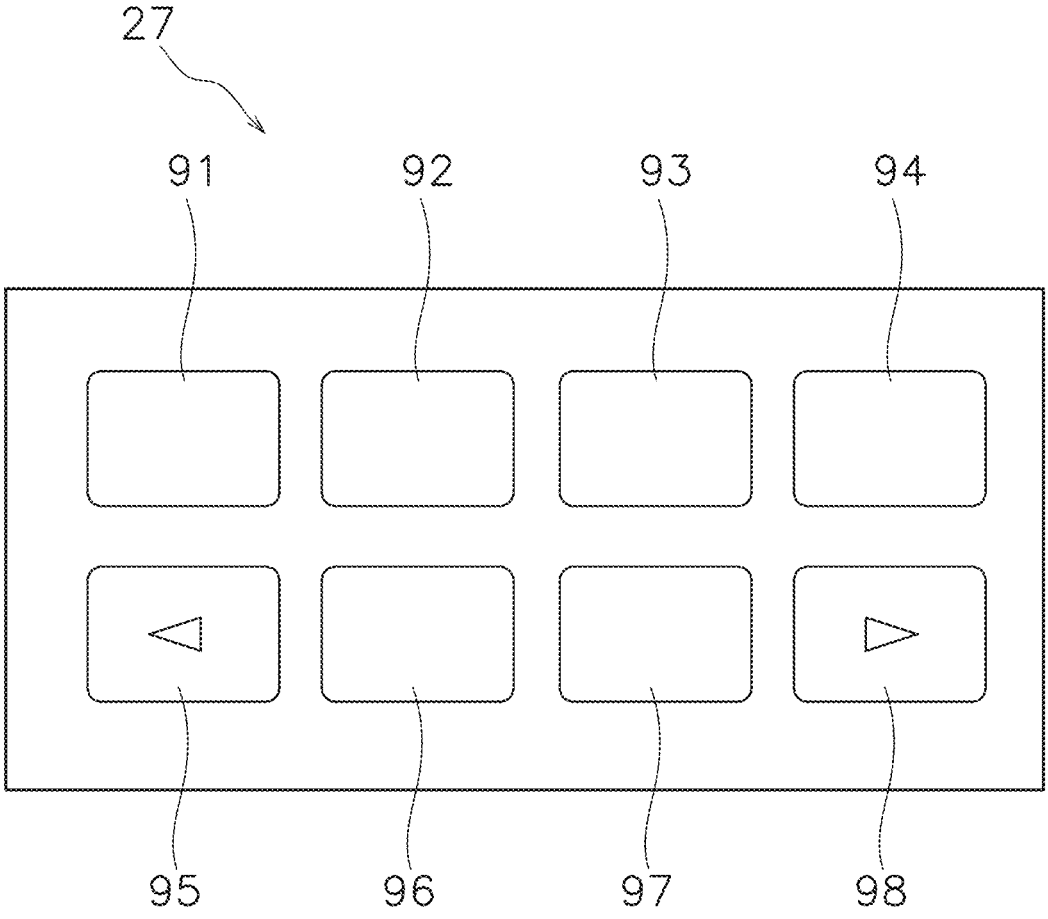
FIG. 5 is a diagram showing an example of an input device.

The input device 27 is operable by the operator to select a control mode of the outboard motors 1*a* and 1*b*. The input device 27 may be provided on the remote controller 25 or the joystick 26. Alternatively, the input device 27 may be provided separately from the remote controller 25 or the joystick 26. FIG. 5 is a diagram showing an example of the input device 27. As illustrated in FIG. 5, the input device 27 includes a plurality of switches 91 to 98. The operator selects the control mode by operating switches 91 to 98. The number of switches is not limited to eight. The number of switches may be less than eight or more than eight. The input device 27 may be a touch screen, or any other suitable device to input information. The input device 27 outputs a command signal indicative of the control mode selected by the operator. The boat maneuvering controller 30 receives the command signal from the input device 27. The boat maneuvering controller 30 controls the outboard motors 1*a* and 1*b* so that the boat 100 moves according to the selected control mode.

Figure 6:
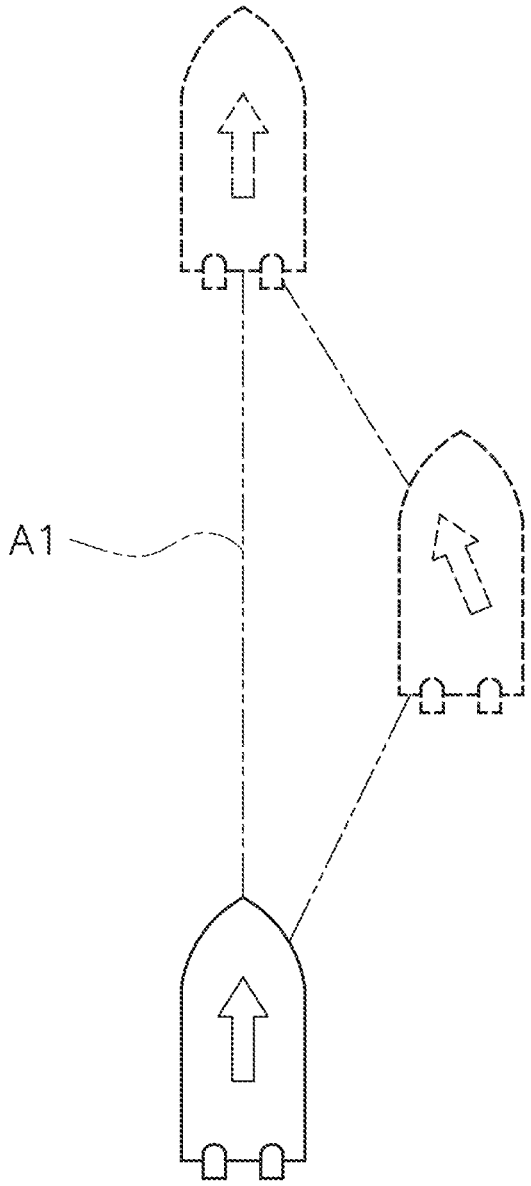
FIG. 6 is a diagram showing a movement of the boat in a course holding mode.

The control mode includes a course holding mode. As illustrated in FIG. 6, the boat maneuvering controller 30 controls the outboard motors 1*a* and 1*b* so that the boat 100 moves according to a predetermined course A1 in the course holding mode. For example, the boat maneuvering controller 30 sets, as the predetermined course A1, a straight path extending from the position of the boat toward the direction of the boat 100 when the course holding mode is selected. Alternatively, the operator may arbitrarily set the predetermined course A1 by using the input device 27. When the boat 100 deviates from the predetermined course A1 due to an influence of wind or tidal current, the boat maneuvering controller 30 controls the outboard motors 1*a* and 1*b* so as to return the boat 100 to the predetermined course A1.

Figure 7:
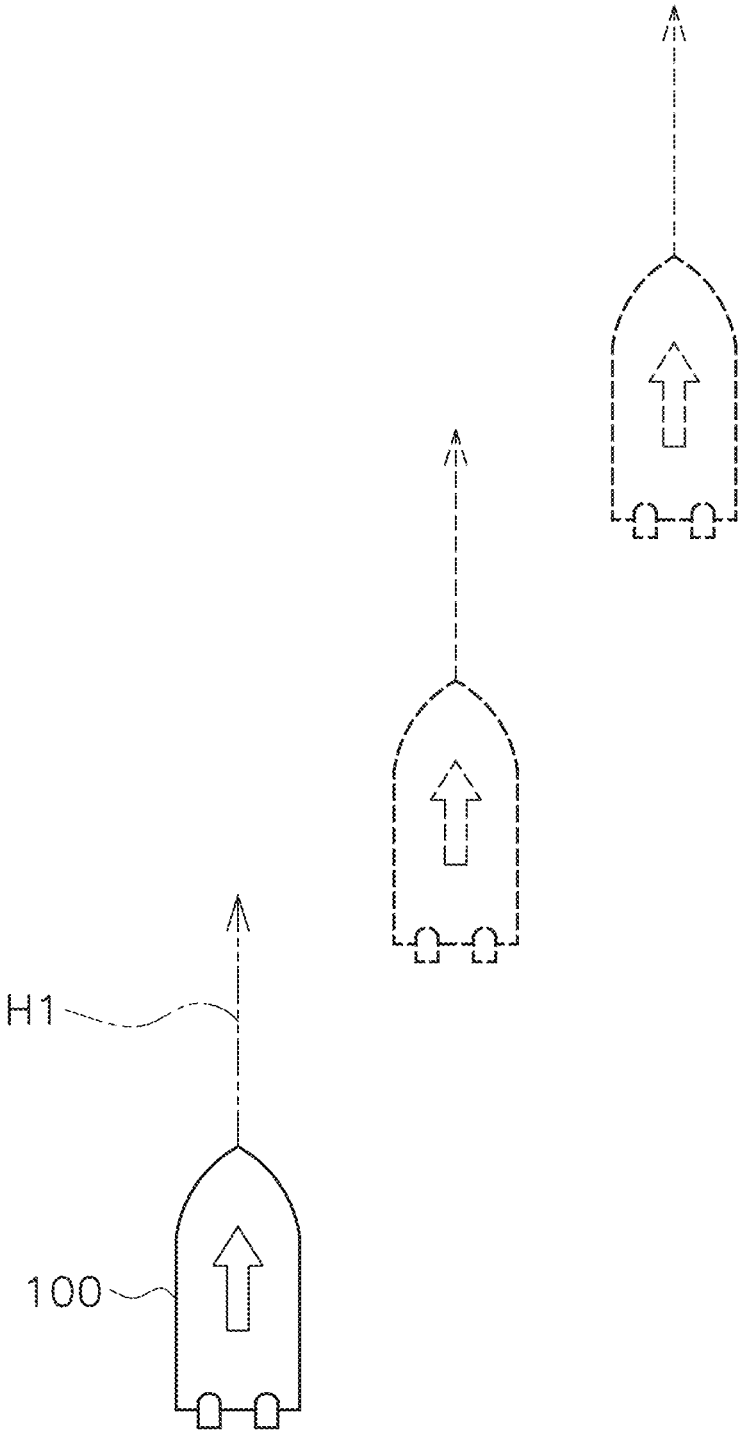
FIG. 7 is a diagram showing a movement of the boat in a heading holding mode.

The control mode includes a heading holding mode. As illustrated in FIG. 7, the boat maneuvering controller 30 controls the outboard motors 1*a* and 1*b* so as to maintain a heading of the boat 100 at a target heading H1 in the heading holding mode. For example, the boat maneuvering controller 30 sets, as the target heading H1, the heading of the boat 100 when the heading holding mode is selected. Alternatively, the operator may arbitrarily set the target heading H1 by using the input device 27. When the boat 100 is swept by the influence of wind or tidal current, the boat maneuvering controller 30 controls the outboard motors 1*a* and 1*b* so as to maintain the heading of the boat 100 at the target heading H1.

Figure 8:
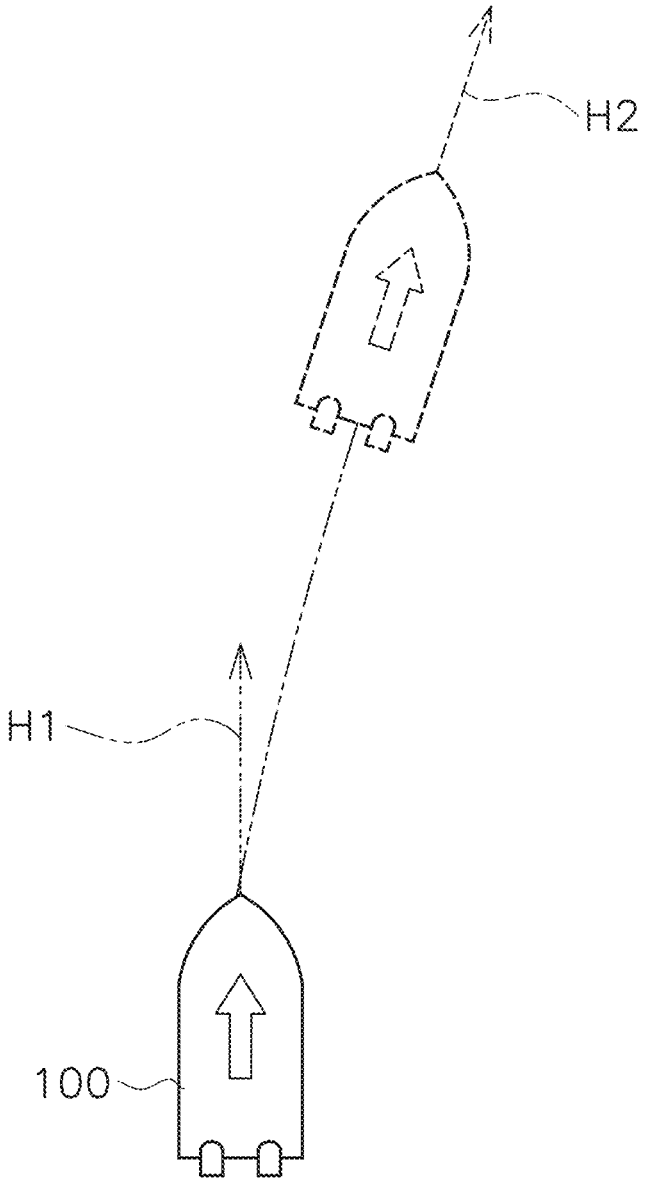
FIG. 8 is a diagram showing a movement of the boat when a right direction button is operated in the heading holding mode.

Further, as illustrated in FIG. 5, the input device 27 includes left and right direction buttons 95 and 98. When the left and right direction buttons 95 and 98 are operated in the heading holding mode, the boat maneuvering controller 30 changes the target heading H1 according to the operation of the left and right direction buttons 95 and 98. For example, when the right direction button 98 is operated, the target heading H1 is changed to the right by a predetermined angle as illustrated in FIG. 8. As a result, the target heading is changed from H1 to H2. Although not illustrated, when the left direction button 95 is operated, the target heading H1 is changed to the left by a predetermined angle.

Figure 9:
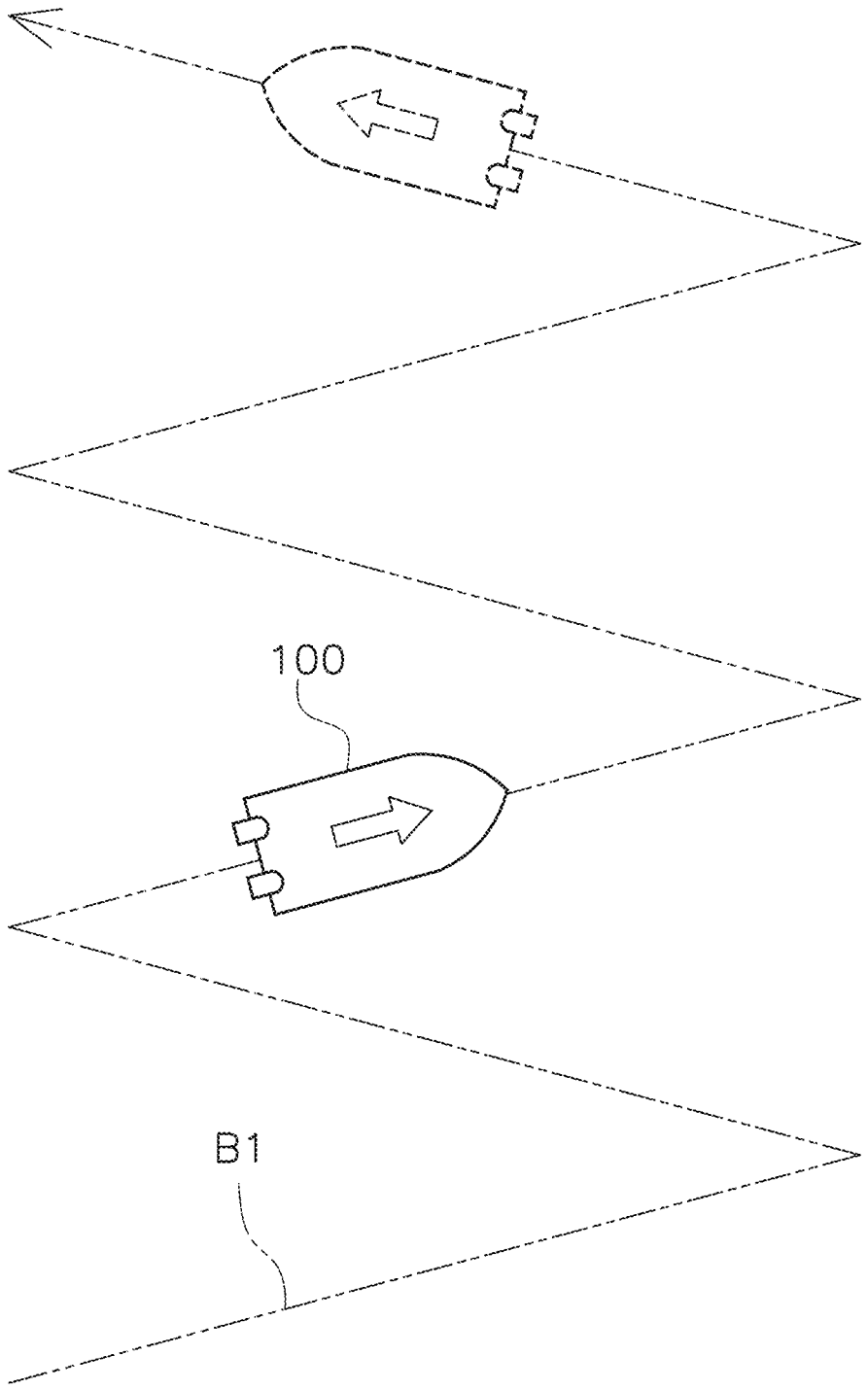
FIG. 9 is a diagram showing a movement of the boat in a zigzag pattern steering mode.
Figure 10:
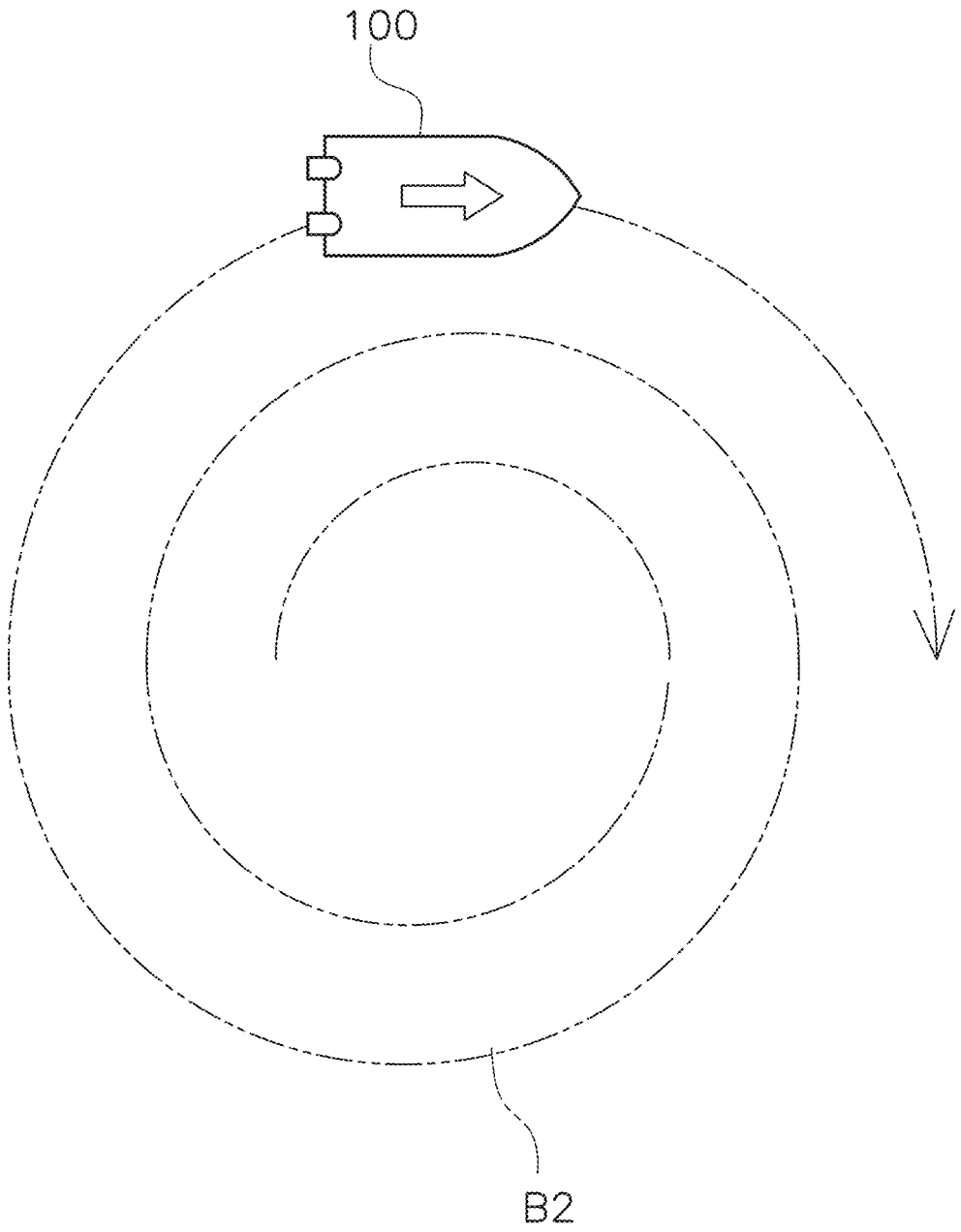
FIG. 10 is a diagram showing a movement of the boat in a spiral pattern steering mode.

The control mode includes a pattern steering mode. The boat maneuvering controller 30 controls the outboard motors 1*a* and 1*b* so as to move the boat 100 according to a predetermined turning pattern in the pattern steering mode. The predetermined turning pattern includes a zigzag turning pattern B1 illustrated in FIG. 9 and a spiral turning pattern B2 illustrated in FIG. 10. The operator selects the turning pattern by the input device 27. When the zigzag turning pattern B1 is selected, the boat maneuvering controller 30 controls the outboard motors 1*a* and 1*b* so as to move the boat 100 in a zigzag pattern in the pattern steering mode. When the spiral turning pattern is selected, the boat maneuvering controller 30 controls the outboard motors 1*a* and 1*b* so as to move the boat 100 in a spiral pattern in the pattern steering mode.

Figure 11:
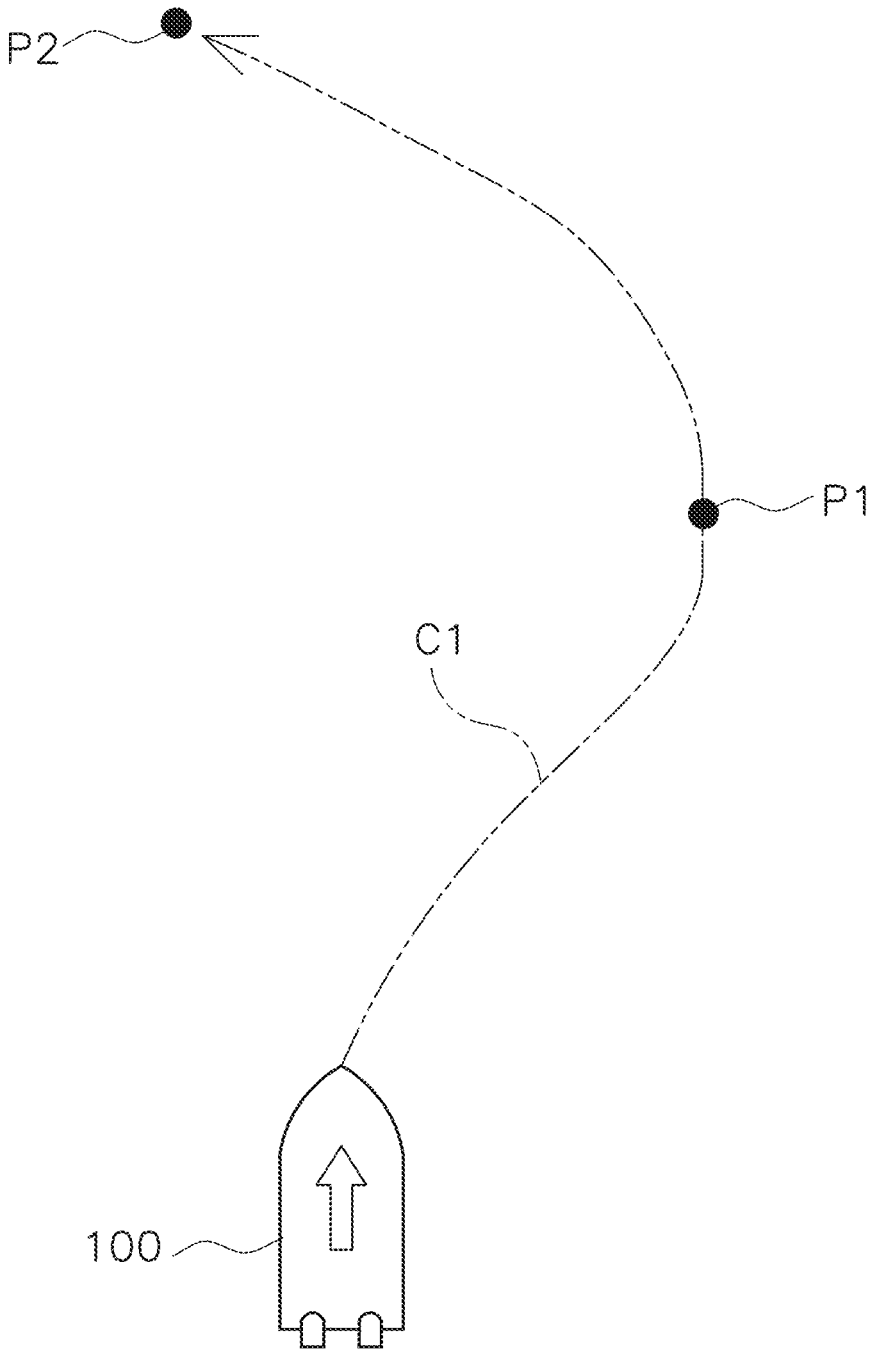
FIG. 11 is a diagram showing a movement of the boat in a track point mode.

The control mode include a track point mode. As illustrated in FIG. 11, the boat maneuvering controller 30 controls the outboard motors 1*a* and 1*b* so as to move the boat 100 according to a trajectory passing through predetermined points P1 and P2 in the track point mode. For example, the operator uses the input device 27 to select the predetermined points P1 and P2. The boat maneuvering controller 30 calculates a target route C1 passing through the predetermined points P1 and P2, and controls the outboard motors 1*a* and 1*b* so as to move the boat 100 along the target route C1.

Figure 12:
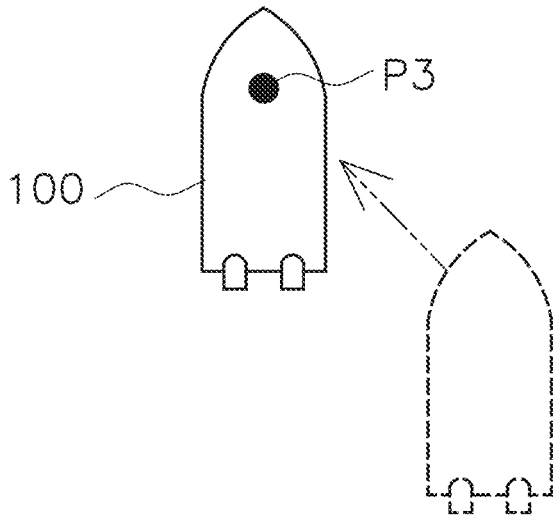
FIG. 12 is a diagram showing a movement of the boat in a fixed point holding mode.

The control mode includes a fixed point holding mode. As illustrated in FIG. 12, in the fixed point holding mode, the boat maneuvering controller 30 controls the outboard motors 1*a* and 1*b* to hold the position of the boat 100 at a predetermined point P3. For example, in the fixed point holding mode, the boat maneuvering controller 30 controls the outboard motors 1*a* and 1*b* to hold the boat 100 at the position of the boat 100 when the fixed point holding mode is selected. Alternatively, in the fixed point holding mode, the boat maneuvering controller 30 may control the outboard motors 1*a* and 1*b* to hold the boat 100 at the position designated by the input device 27. When the position of the boat 100 deviates from the predetermined point P3, the boat maneuvering controller 30 controls the outboard motors 1*a* and 1*b* so as to return the boat 100 to the predetermined point P3.

Figure 13:
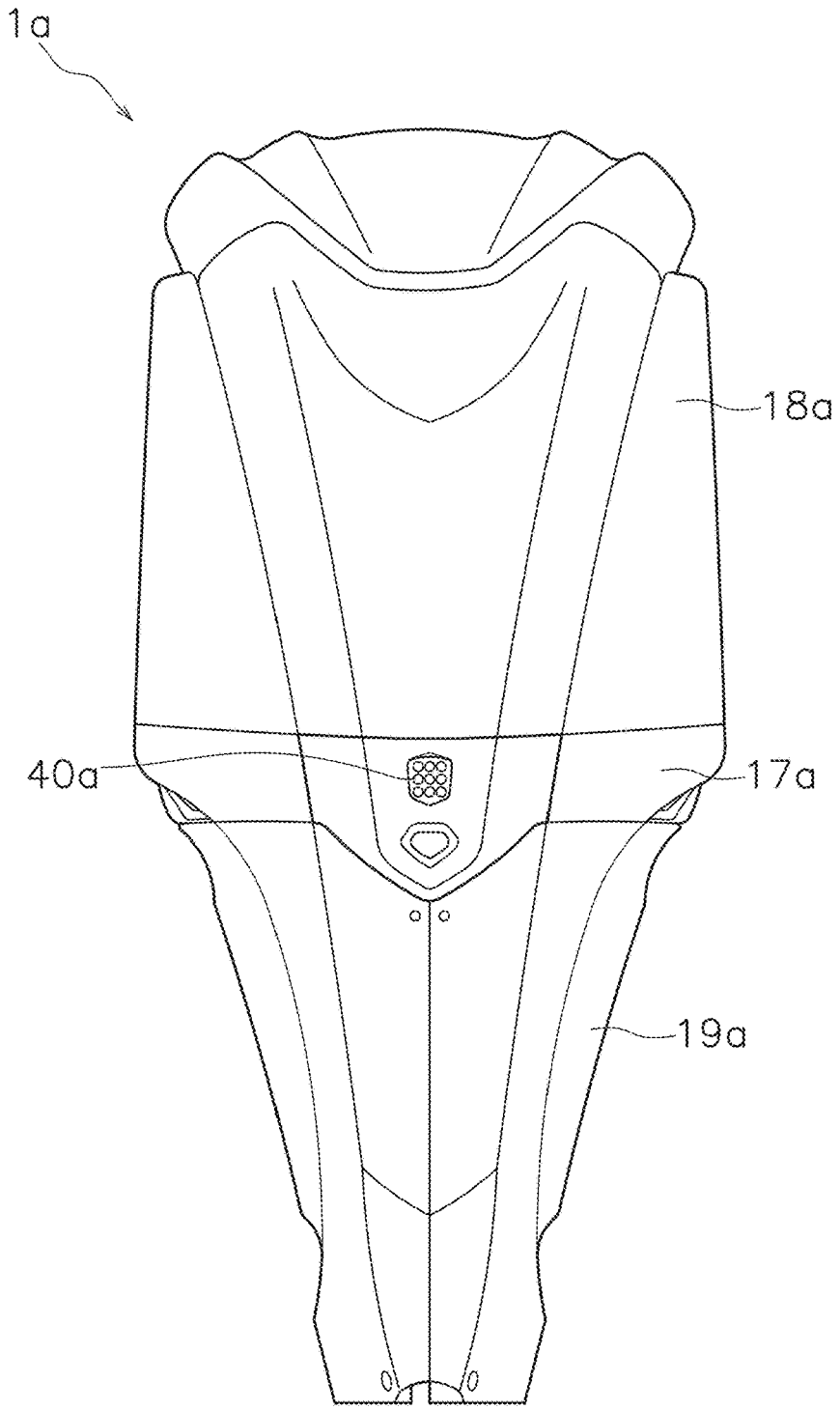
FIG. 13 is a rear view of the outboard motor.
Figure 14:
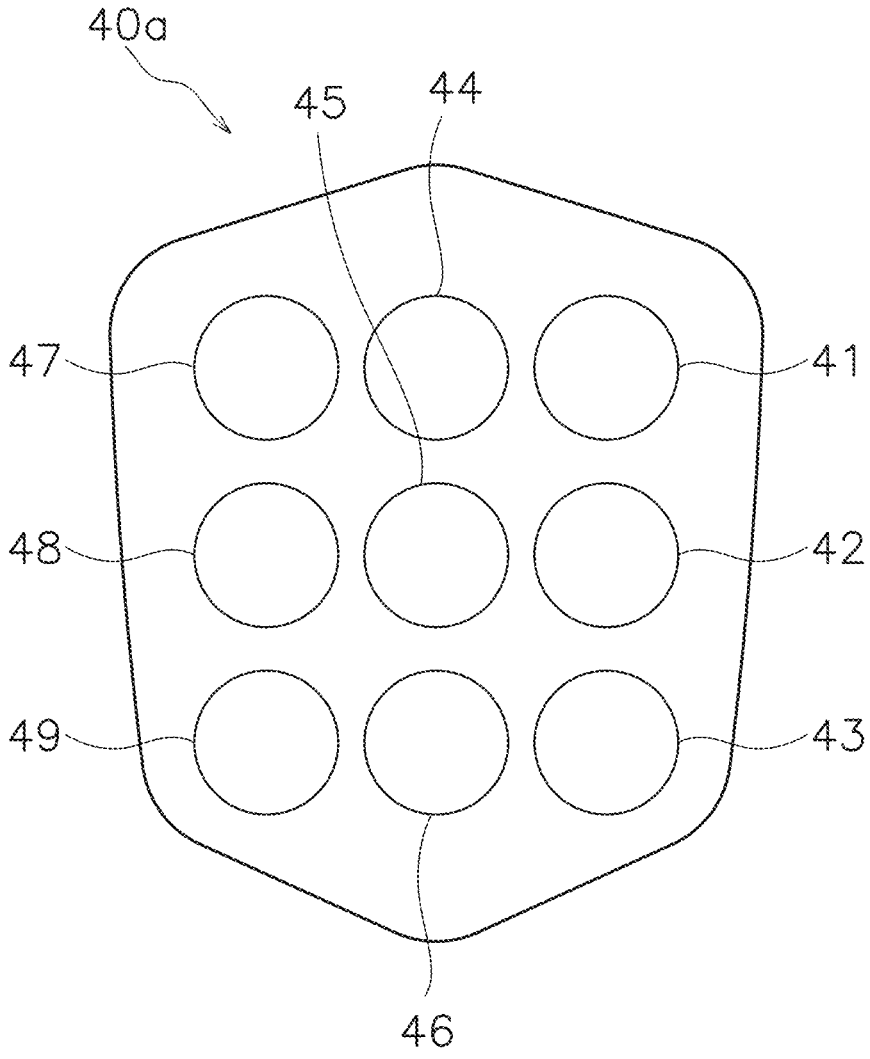
FIG. 14 is an enlarged view of a rear portion of the outboard motor.

FIG. 13 is a rear view of the outboard motor 1*a*. As illustrated in FIG. 13, the outboard motor 1*a* includes a light unit 40*a*. The light unit 40*a* is located on the rear surface of the housing 10*a*. The light unit 40*a* is located on the rear surface of the bottom cowl 17*a*, for example. FIG. 14 is an enlarged view of the light unit 40*a*. The light unit 40*a* includes a plurality of light sources 41 to 49. The light sources 41 to 49 are, for example, LEDs or bulbs. The plurality of light sources 41 to 49 are arranged side by side in the vertical and horizontal directions. The number of light sources is not limited to nine. The number of light sources may be less than or greater than nine.

The boat maneuvering controller 30 transmits a command signal to the light unit 40*a* via the first drive controller 9*a*. The boat maneuvering controller 30 controls the light unit 40*a* to light at least a portion of the plurality of light sources 41 to 49 in a pattern indicating the movement of the boat 100 according to the control mode. During the course holding mode, the heading holding mode, the track point mode, the fixed point holding mode, and the movement modes by the joystick 26, the boat maneuvering controller 30 lights at least a portion of the plurality of light sources 41 to 49 so as to indicate the moving direction of the boat 100.

Figure 15:
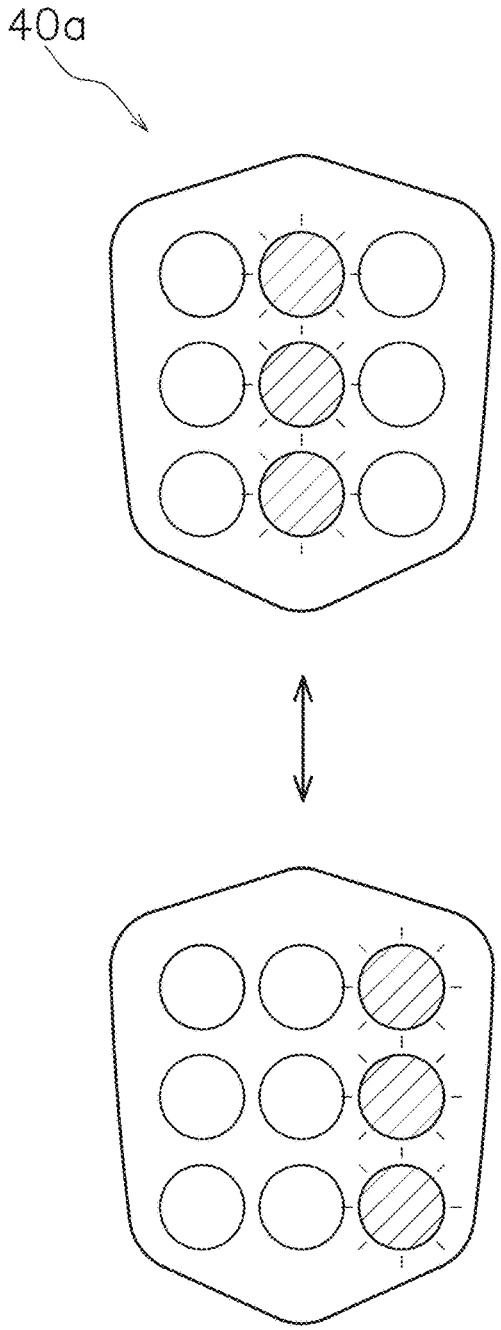
FIG. 15 is a diagram showing a lighting pattern during a rightward movement of the boat.
Figure 16:
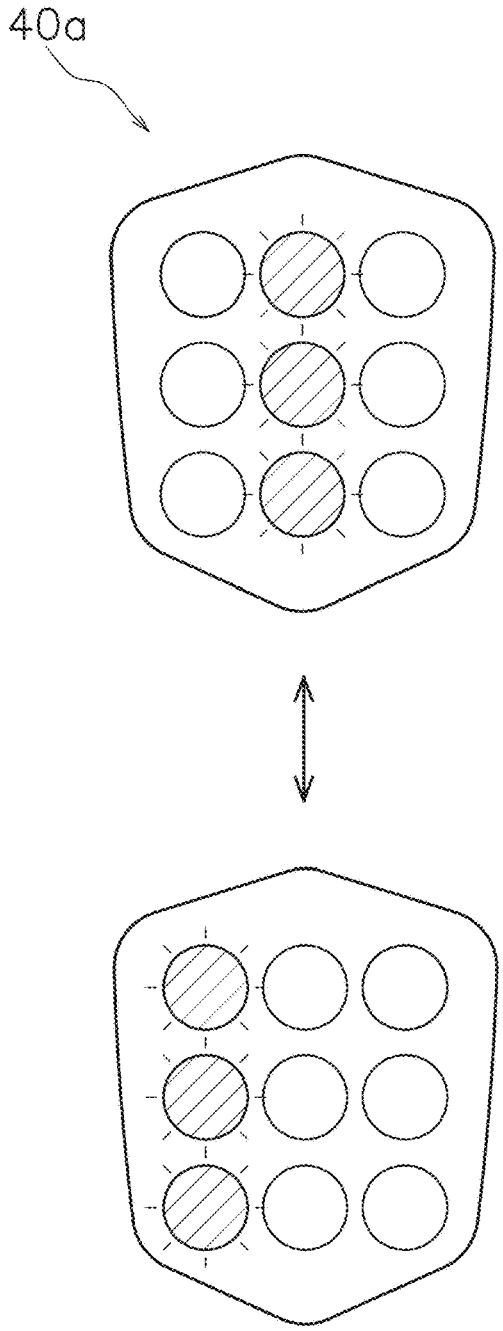
FIG. 16 is a diagram showing a lighting pattern during a leftward movement of the boat.
Figure 17:
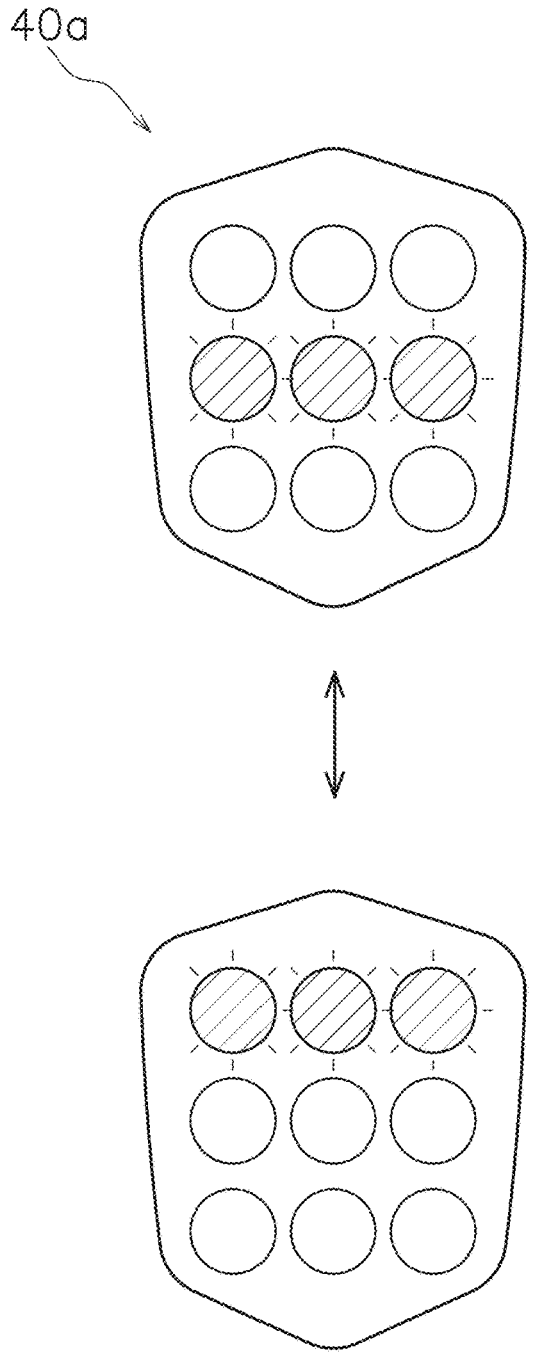
FIG. 17 is a diagram showing a lighting pattern during a forward movement of the boat.
Figure 18:
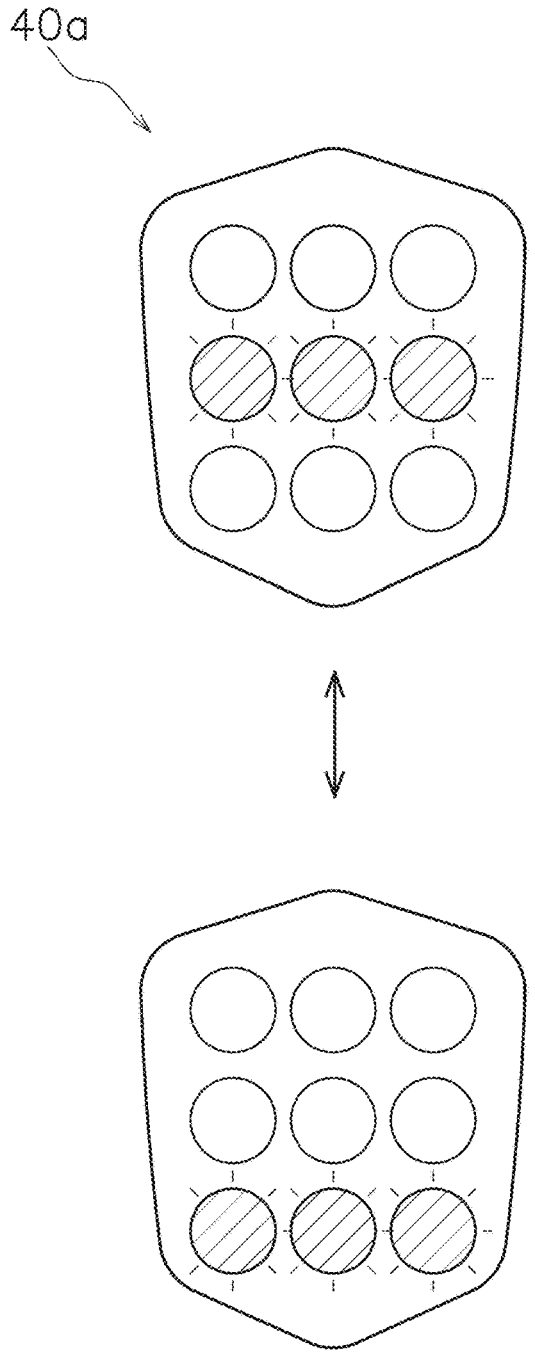
FIG. 18 is a diagram showing a lighting pattern during a rearward movement of the boat.

For example, when the boat 100 moves to the right, the boat maneuvering controller 30 alternately repeats the blinking of the light sources in the center column and the blinking of the light sources in the right column, as illustrated in FIG. 15. When the boat 100 moves to the left, the boat maneuvering controller 30 alternately repeats the blinking of the light sources in the center column and the blinking of the light sources in the left column, as illustrated in FIG. 16. When the boat 100 moves forward, the boat maneuvering controller 30 alternately repeats the blinking of the light sources in the center row and the blinking of the light sources in the upper row, as illustrated in FIG. 17. When the boat 100 moves rearward, the boat maneuvering controller 30 alternately repeats the blinking of the light sources in the center row and the blinking of the light sources in the lower row, as illustrated in FIG. 18.

Figure 19:
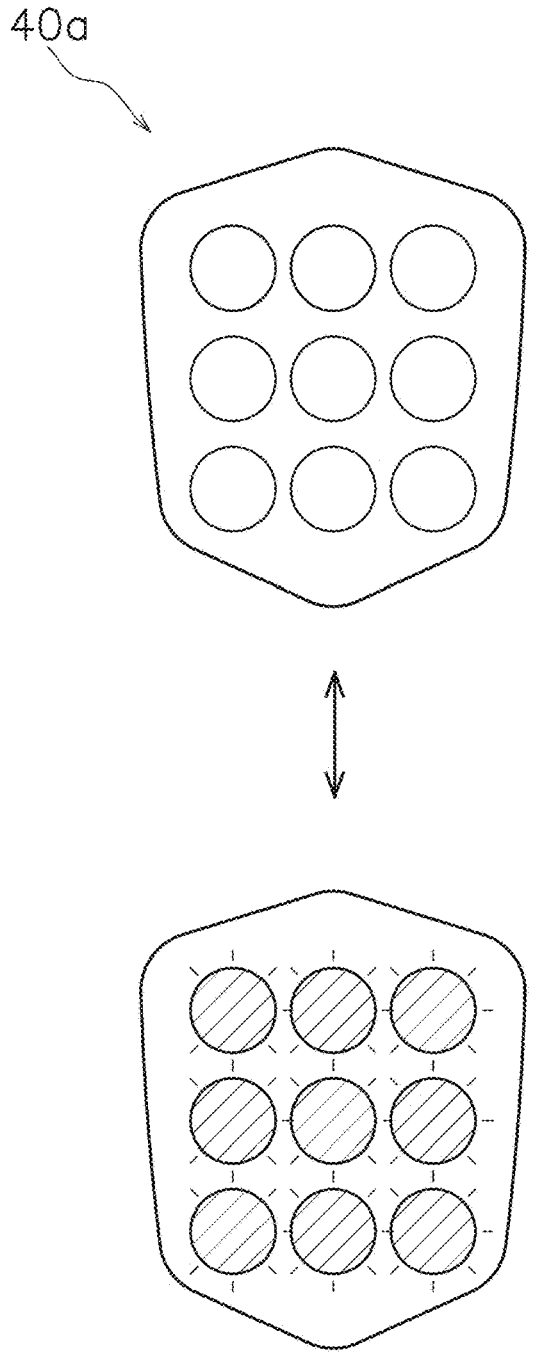
FIG. 19 is a diagram showing a lighting pattern in the fixed point holding mode.

During the fixed point holding mode, the boat maneuvering controller 30 may blink all of the plurality of light sources as illustrated in FIG. 19. In the drawings, a hatched light source among the plurality of light sources indicates that the light source is turned on, and a light source without hatching indicates that the light source is turned off.

Figure 20:
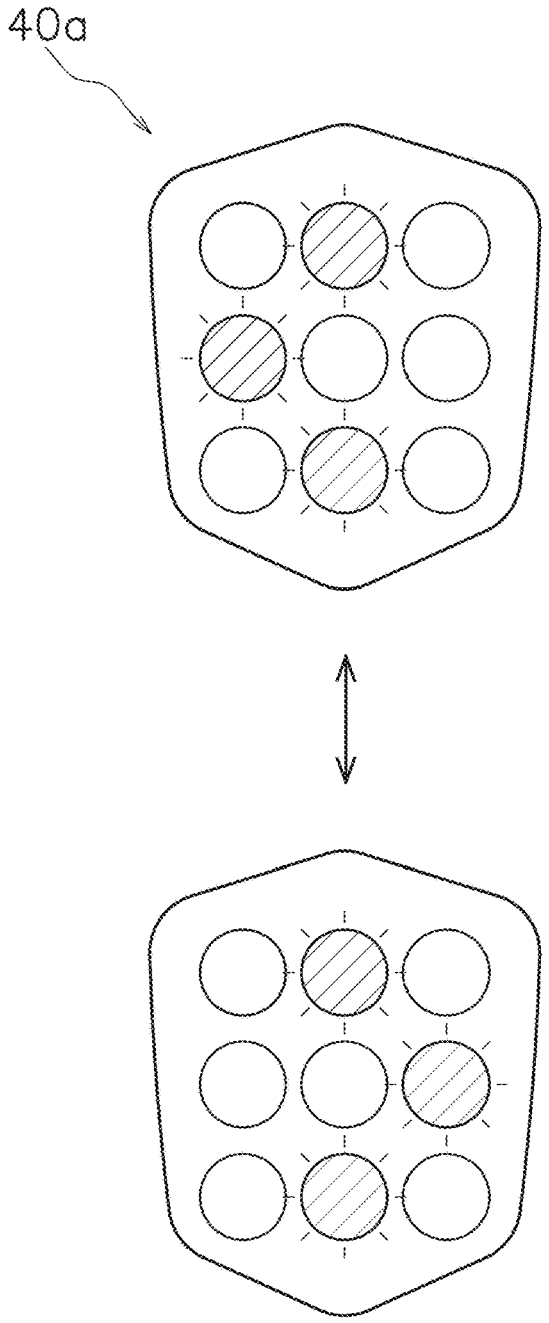
FIG. 20 is a diagram showing a lighting pattern in the zigzag pattern steering mode.

During the pattern steering mode, the boat maneuvering controller 30 lights at least a portion of the plurality of light sources to show a predetermined turning pattern. When the zigzag turning pattern is selected, the boat maneuvering controller 30 lights at least a portion of the plurality of light sources in a zigzag pattern. For example, as illustrated in FIG. 20, the boat maneuvering controller 30 blinks the light sources alternately in a pattern bent to the right and a pattern bent to the left.

Figure 21:
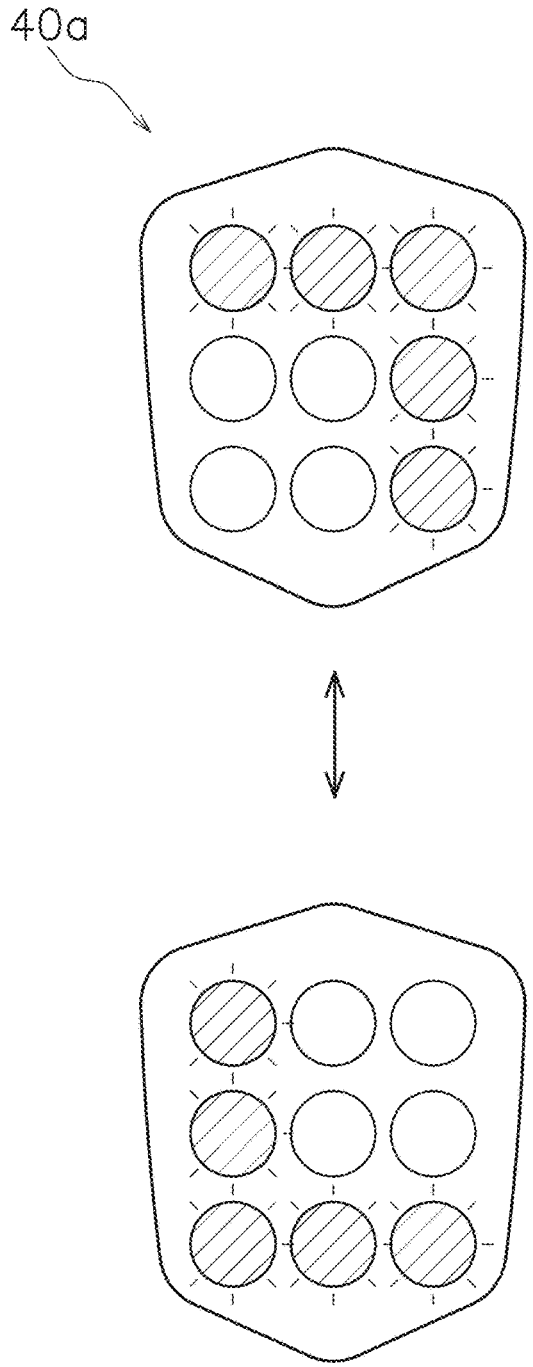
FIG. 21 is a diagram showing a lighting pattern in the spiral pattern steering mode.

When the spiral turning pattern is selected, the boat maneuvering controller 30 lights at least a portion of the plurality of light sources in a spiral pattern. The boat maneuvering controller 30 switches the blinking of the light sources so that the plurality of light sources appear to rotate. For example, as illustrated in FIG. 21, the boat maneuvering controller 30 alternately repeats blinking of the light sources in the upper row and the light sources in the right column and blinking of the light sources in the lower row and the light sources in the left column.

The boat maneuvering controller 30 lights at least a portion of the plurality of light sources to indicate the pivot turning of the boat 100 in response to the twisting operation of the joystick 26. In that case, for example, the boat maneuvering controller 30 may blink a plurality of light sources in the same manner as the pattern illustrated in FIG. 21. Alternatively, the boat maneuvering controller 30 may blink the plurality of light sources so that the light appears to rotate, not limited to the pattern illustrated in FIG. 21, during the spiral pattern steering mode or during the twisting operation of the joystick 26.

Figure 22:
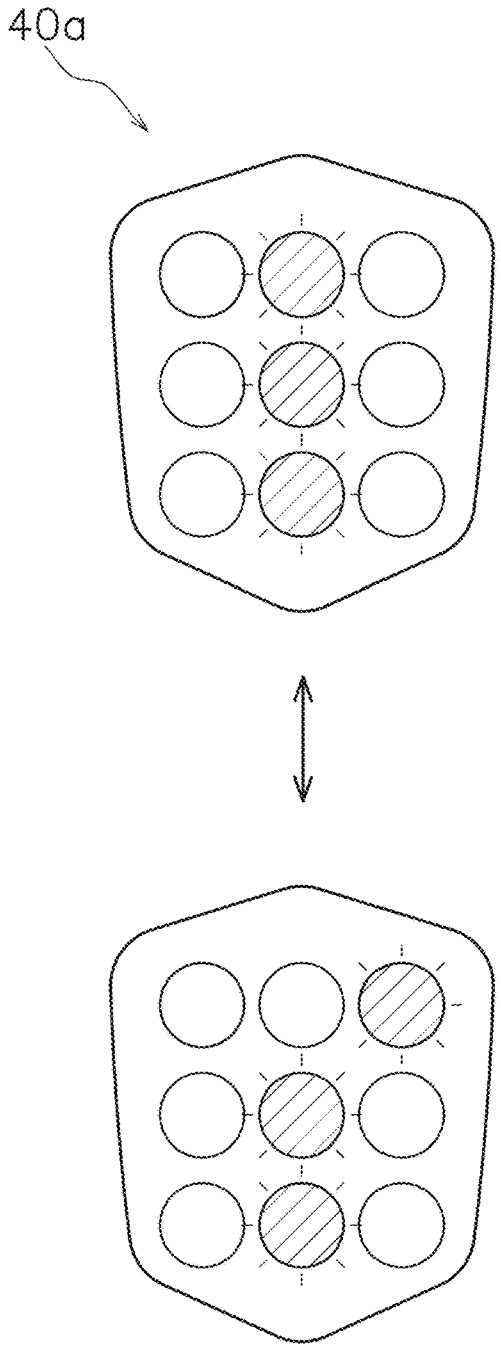
FIG. 22 is a diagram showing a lighting pattern when the right direction button is operated in the heading holding mode.
Figure 23:
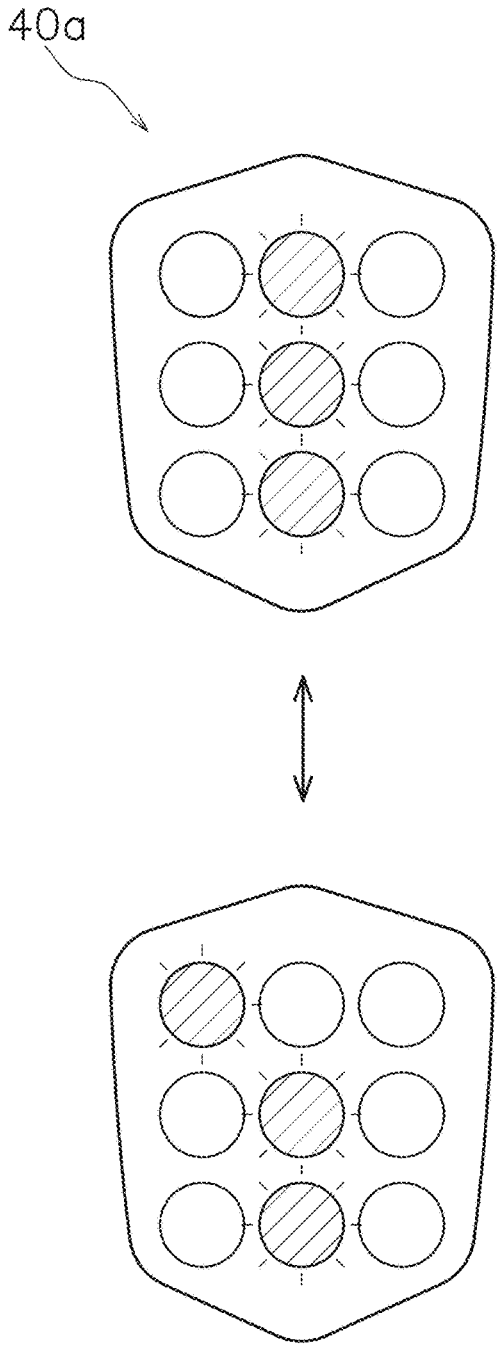
FIG. 23 is a diagram showing a lighting pattern when a left direction button is operated in the heading holding mode.

When the left and right direction buttons 95 and 98 are operated in the heading holding mode, the boat maneuvering controller 30 lights the plurality of light sources to indicate the movement of the boat 100 in response to the operation of the left and right direction buttons 95 and 98. For example, in the heading holding mode, when the right direction button 98 is operated, as illustrated in FIG. 22, the boat maneuvering controller 30 blinks the plurality of light sources to show the trajectory of the boat 100 that is curved to the right. In the heading holding mode, when the left direction button 95 is operated, as illustrated in FIG. 23, the boat maneuvering controller 30 blinks the plurality of light sources to show the trajectory of the boat 100 that is curved to the left. As illustrated in FIG. 3, the outboard motor 1*b* includes a light unit 40*b*. The light unit 40*b* has the same configuration as the light unit 40*a*. Similar to the light unit 40*a*, the boat maneuvering controller 30 lights the light sources of the light unit 40*b* according to the control mode.

In the outboard motors 1*a* and 1*b* according to the preferred embodiments described above, the plurality of light sources are turned on in a pattern indicating the movement of the boat 100 according to the control mode during the execution of the control mode. As a result, it is possible to notify the operation of the outboard motors 1*a* and 1*b* to the people around the outboard motors 1*a* and 1*b*.

Figure 24:
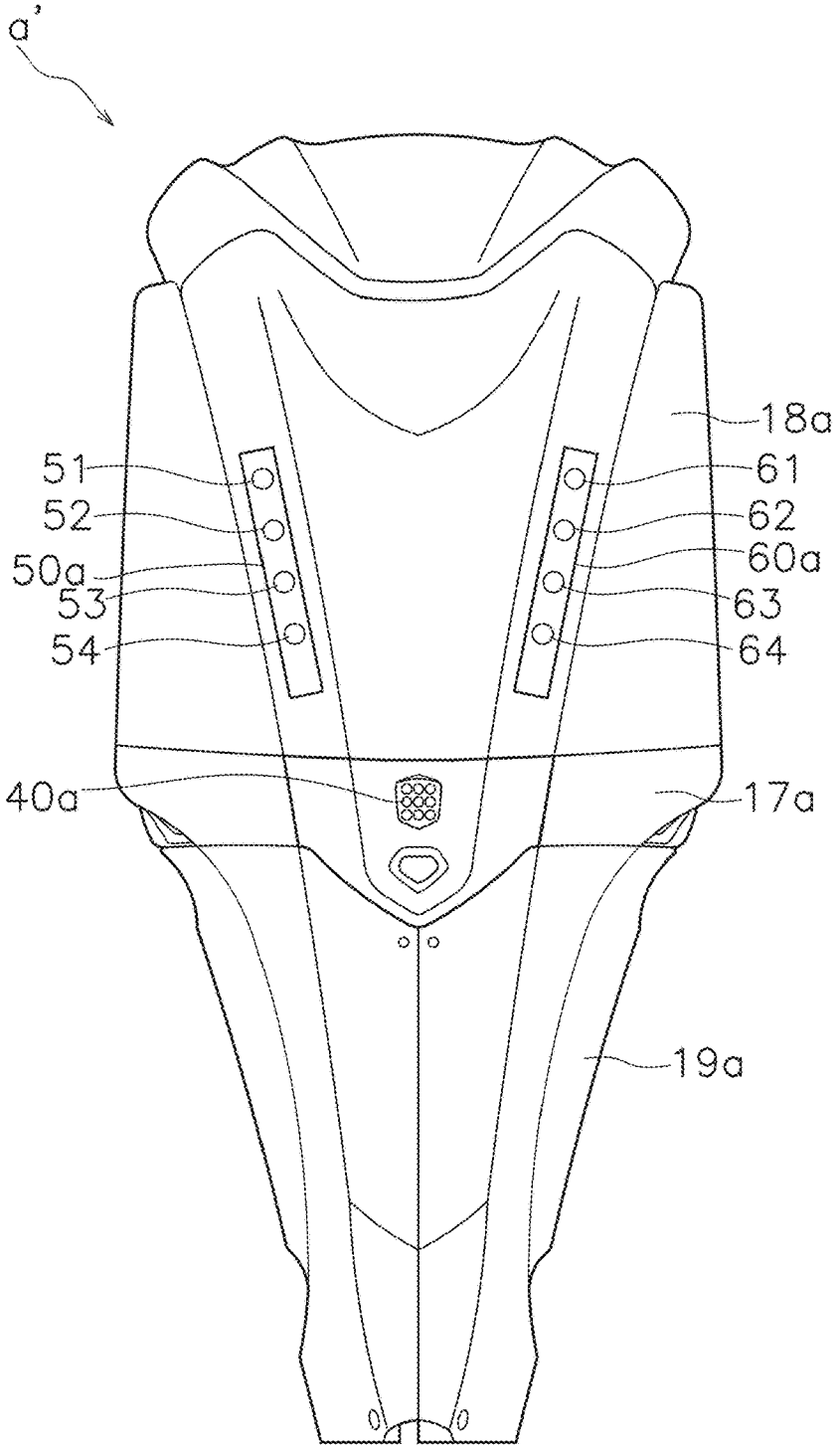
FIG. 24 is a rear view of the outboard motor according to a second preferred embodiment of the present invention.

FIG. 24 is a rear view showing the outboard motor 1*a'* according to a second preferred embodiment of the present invention. The outboard motor 1*a'* includes a left light unit 50*a* and a right light unit 60*a*. The other configuration of the outboard motor 1*a'* is the same as that of the outboard motor 1*a* according to the first preferred embodiment. The left light unit 50*a* and the right light unit 60*a* are located on the top cowl 18*a*.

The left light unit 50*a* includes a plurality of light sources 51 to 54. The right light unit 60*a* includes a plurality of light sources 61 to 64. The number of light sources of the left light unit 50*a* and the number of light sources of the right light unit 60*a* are not limited to four, respectively. The number of light sources in the left light unit 50*a* and the number of light sources in the right light unit 60*a* may be more than four or less than four. The boat maneuvering controller 30 controls the light units 50*a* and 60*a* to light the plurality of light sources 51 to 54 of the left light unit 50*a* and the plurality of light sources 61 to 64 of the right light unit 60*a* in a pattern that indicates the movement of the boat 100 according to the control mode in addition to the lighting of the light unit 40*a* described above.

Figure 25:
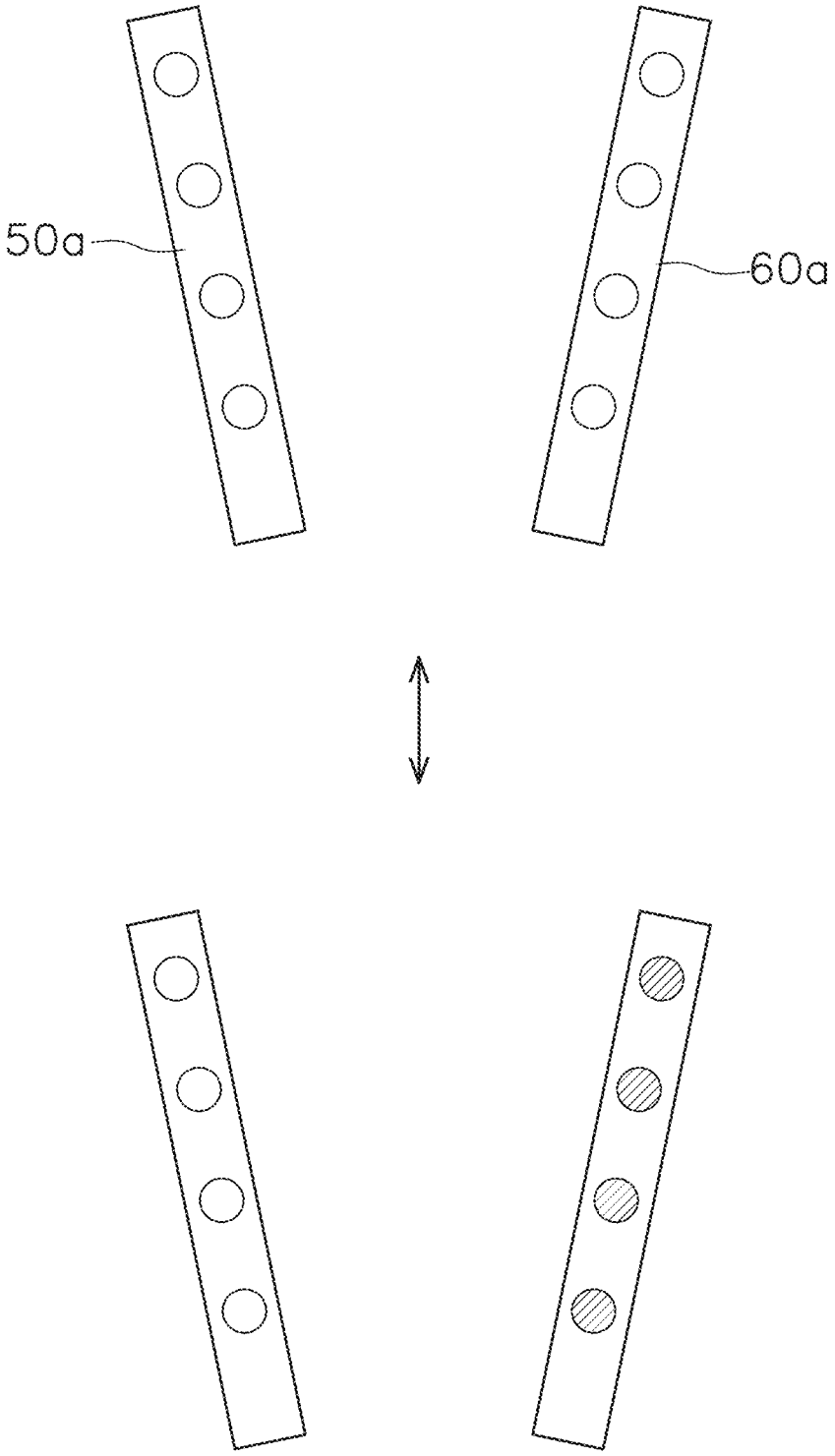
FIG. 25 is a diagram showing a lighting pattern during the rightward movement of the boat.
Figure 26:
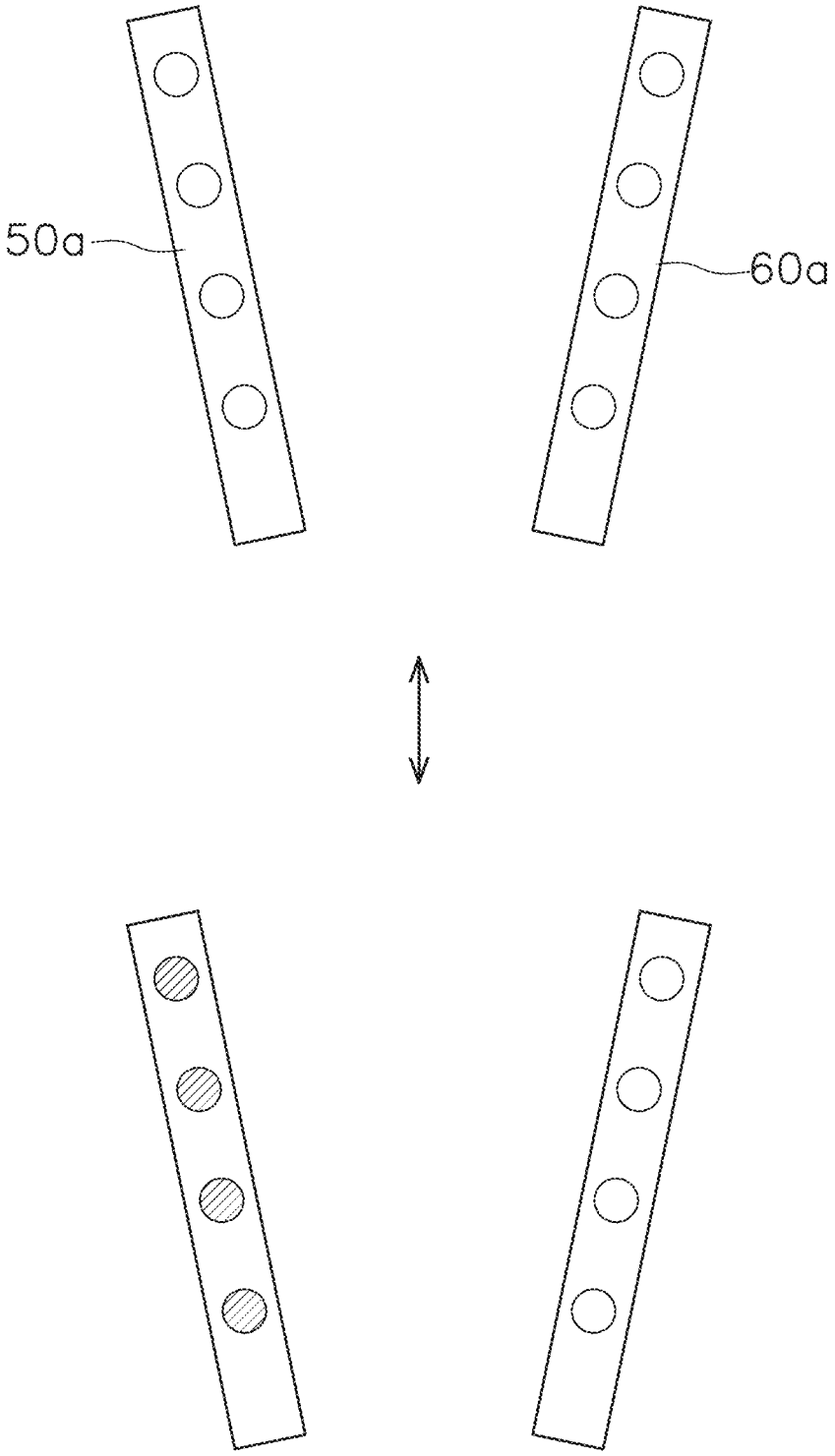
FIG. 26 is a diagram showing a lighting pattern during the leftward movement of the boat.
Figure 27:
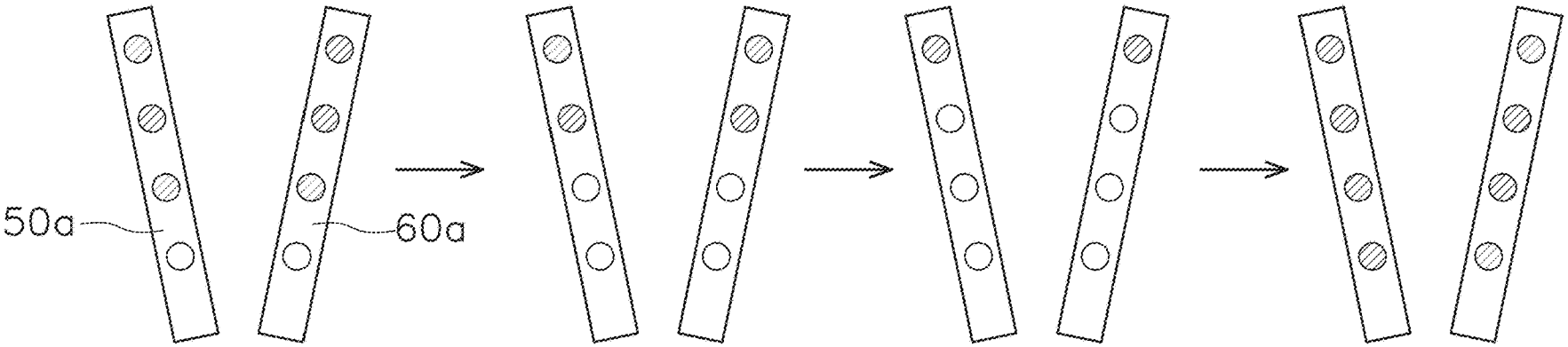
FIG. 27 is a diagram showing a lighting pattern during the forward movement of the boat.
Figure 28:
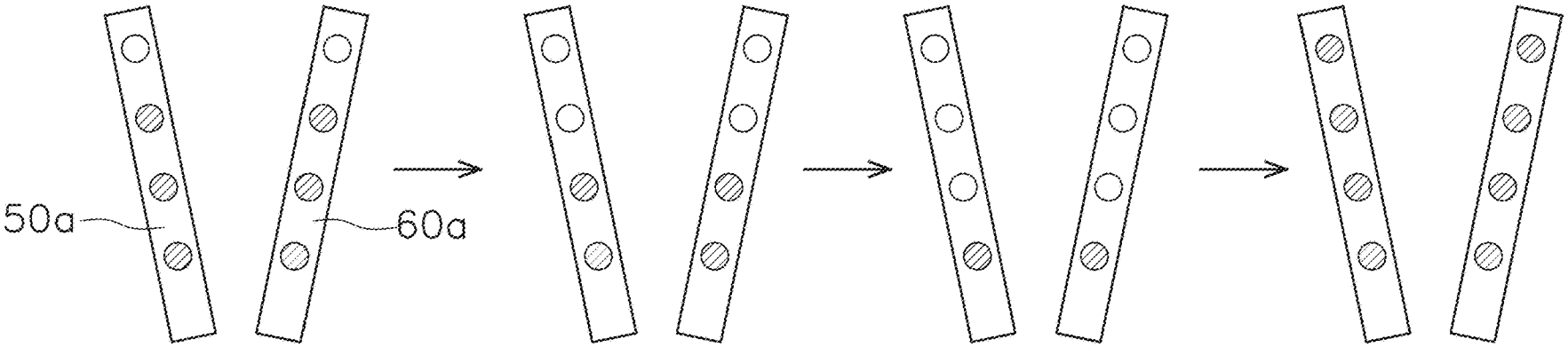
FIG. 28 is a diagram showing a lighting pattern during the rearward movement of the boat.

For example, when the boat 100 moves to the right, the boat maneuvering controller 30 blinks the plurality of light sources of the right light unit 60*a* as illustrated in FIG. 25. When the boat 100 moves to the left, the boat maneuvering controller 30 blinks the plurality of light sources of the left light unit 50*a* as illustrated in FIG. 26. When the boat 100 moves forward, as illustrated in FIG. 27, the boat maneuvering controller 30 repeats a pattern of turning off the lights in order from the lower light source to the upper light source in the left light unit 50*a* and the right light unit 60*a* and then turning on all the light sources. When the boat 100 moves rearward, as illustrated in FIG. 28, the boat maneuvering controller 30 repeats a pattern of turning off the lights in order from the upper light source to the lower light source in the left light unit 50*a* and the right light unit 60*a* and then turning on all the light sources.

In the fixed point holding mode, the boat maneuvering controller 30 may blink all of the plurality of light sources in the left light unit 50*a* and the right light unit 60*a*.

Although preferred embodiments of the present invention have been described above, the present invention is not limited to the above-described preferred embodiments, and various modifications can be made without departing from the gist of the present invention.

The structure of the outboard motor is not limited to that of the above-described preferred embodiments, and may be changed. For example, the drive unit 2*a* is not limited to the internal combustion engine, and may be an electric motor. Alternatively, the drive unit 2*a* may be a hybrid boat maneuvering system of an internal combustion engine and an electric motor. The number of outboard motors is not limited to two. The number of outboard motors may be one or more than two.

The shape or position of the light unit is not limited to that of the above-described preferred embodiments, and may be changed. The light unit is not limited to a circular shape, and may have other shapes. The number or arrangement of light sources is not limited to that of the above-described preferred embodiments, and may be changed.

The boat maneuvering controller 30 may turn on the light source in a state other than the execution of the control mode. For example, the boat maneuvering controller 30 may turn on the light source when the engine is started. The boat maneuvering controller 30 may turn on the light source while driving the engine. The boat maneuvering controller 30 may turn on the light source according to the change in the rotational speed of the engine. The lighting pattern of the light source is not limited to that of the above-described preferred embodiments, and may be changed. The lighting of the light source may be constant lighting or blinking. The plurality of light sources may be turned on at the same time, or may be turned on with a time lag. Further, the lighting and extinguishing of the plurality of light sources may be switched so that the light appears to move.

The boat maneuvering controller 30 may turn on the navigation light of the boat in conjunction with the lighting of the plurality of light sources of the light unit described above. As a result, it is possible to notify the boats or people around the boat 100 that the boat 100 is performing automatic maneuvering. The boat maneuvering controller 30 may include information indicative of that the boat 100 is performing automatic maneuvering in a signal output by the AIS (Automatic Identification System) as well as lighting of the plurality of light sources of the light unit.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling an outboard motor attached to a boat, the system comprising:

an input operable by an operator to select a control mode of the outboard motor;

a light unit including a plurality of light sources on an outer surface of the outboard motor, the plurality of light sources arranged in a plurality of columns arranged vertically and a plurality of rows arranged horizontally; and a controller connected to the input and the light unit and configured or programmed to:

control the outboard motor according to the control mode; and control the light unit to light at least a portion of the plurality of light sources so that a shape of a combination of the plurality of lit light sources indicates a movement of the boat according to the control mode.

2. The system according to claim 1, wherein the control mode includes a course holding mode; and the controller is further configured or programmed to:

control the outboard motor to move the boat according to a predetermined course in the course holding mode; and light at least a portion of the plurality of the light sources to show the movement of the boat moving according to the predetermined course.

3. The system according to claim 1, wherein the input includes a left direction button and a right direction button;

the control mode includes a heading holding mode; and the controller is further configured or programmed to:

control the outboard motor to maintain a heading of the boat at a target heading in the heading holding mode; and when the left direction button or the right direction button is operated in the heading holding mode, change the target heading according to an operation of the left direction button or the right direction button and light at least a portion of the plurality of light sources to show the movement of the boat moving left or right according to the operation of the left direction button or the right direction button.

4. The system according to claim 1, wherein the control mode includes a pattern steering mode; and the controller is further configured or programmed to:

control the outboard motor to move the boat according to a predetermined turning pattern in the pattern steering mode; and light at least a portion of the plurality of light sources to show the predetermined turning pattern.

5. The system according to claim 4, wherein the predetermined turning pattern includes a zigzag pattern; and the controller is further configured or programmed to:

control the outboard motor to move the boat in the zigzag pattern in the pattern steering mode; and light at least a portion of the plurality of light sources in the zigzag pattern.

6. The system according to claim 4, wherein the predetermined turning pattern includes a spiral pattern; and the controller is further configured or programmed to:

control the outboard motor to move the boat in the spiral pattern in the pattern steering mode; and light at least a portion of the plurality of light sources in the spiral pattern.

7. The system according to claim 1, wherein the control mode includes a track point mode; and the controller is further configured or programmed to:

control the outboard motor in the track point mode to move the boat according to a trajectory passing through a predetermined point; and light at least a portion of the plurality of light sources to show the movement of the boat.

8. The system according to claim 1, wherein the control mode includes a fixed point holding mode; and the controller is further configured or programmed to:

control the outboard motor to hold a position of the boat at a predetermined point in the fixed point holding mode;

when the position of the boat deviates from the predetermined position, control the outboard motor to return the boat to the predetermined position; and light at least a portion of the plurality of light sources to show the movement of the boat returning to the predetermined position.

9. The system according to claim 1, wherein the input includes a joystick; and the controller is further configured or programmed to:

control the outboard motor to move the boat in a direction corresponding to an operation of the joystick; and light at least a portion of the plurality of the light sources to show the movement of the boat in the direction corresponding to the operation of the joystick.

10. The system according to claim 9, wherein the controller is further configured or programmed to:

control the outboard motor to move the boat forward or rearward in response to a forward or rearward operation of the joystick; and light at least a portion of the plurality of light sources to show a forward or rearward movement of the boat.

11. The system according to claim 9, wherein the controller is further configured or programmed to:

control the outboard motor to move the boat left or right in response to a left or right operation of the joystick; and light at least a portion of the plurality of light sources to show a left or right movement of the boat.

12. The system according to claim 9, wherein the controller is further configured or programmed to:

control the outboard motor to turn the boat in response to a twisting operation of the joystick; and light at least a portion of the plurality of light sources to show a turning of the boat.

13. The system according to claim 1, further comprising:

a left light unit including a plurality of light sources; and a right light unit including a plurality of light sources; wherein the controller is further configured or programmed to light at least a portion of the plurality of light sources of the left light unit and the plurality of light sources of the right light unit in a pattern indicating the movement of the boat according to the control mode.

14. The system according to claim 1, wherein the plurality of light sources are provided on a rear surface of the outboard motor.

15. A method for controlling an outboard motor attached to a boat, the boat including a light unit including a plurality of light sources, the plurality of light sources arranged in a plurality of columns arranged vertically and a plurality of rows arranged horizontally, the method comprising:

receiving a signal indicative of a control mode of the outboard motor;

controlling the outboard motor according to the control mode; and controlling the light unit to light at least a portion of the plurality of light sources so that a shape of a combination of the plurality of lit light sources indicates a movement of the boat according to the control mode; wherein the plurality of light sources are provided on an outer surface of the outboard motor.

16. The method according to claim 15, wherein the control mode includes a course holding mode, and the method further comprises:

controlling the outboard motor to move the boat according to a predetermined course in the course holding mode; and lighting at least a portion of the plurality of light sources to show the movement of the boat moving according to the predetermined course.

17. The method according to claim 15, wherein the control mode includes a heading holding mode, and the method further comprises:

controlling the outboard motor in the heading holding mode to maintain a heading of the boat at a target heading;

when a signal indicative of a left or right direction command is received in the heading holding mode, changing the target heading in response to the left or right direction command; and lighting at least a portion of the plurality of light sources to show the movement of the boat moving left or right in response to the left or right direction command.

18. The method according to claim 15, wherein the control mode includes a pattern steering mode, and the method further comprises:

controlling the outboard motor in the pattern steering mode to move the boat according to a predetermined turning pattern; and lighting at least a portion of the plurality of light sources to show the predetermined turning pattern.

19. The method according to claim 15, wherein the control mode includes a track point mode, and the method further comprises:

controlling the outboard motor in the track point mode to move the boat according to a trajectory passing through a predetermined point; and lighting at least a portion of the plurality of light sources to show the movement of the boat.

20. The method according to claim 15, wherein the control mode includes a fixed point holding mode, and the method further comprises:

controlling the outboard motor in the fixed point holding mode to hold a position of the boat at a predetermined point;

when the position of the boat deviates from the predetermined position, controlling the outboard motor to return the boat to the predetermined position; and lighting at least a portion of the plurality of light sources to show the movement of the boat returning to the predetermined position.

21. The method according to claim 15, further comprising:

receiving a signal indicative of an operation of a joystick;

controlling the outboard motor to move the boat in a direction corresponding to the operation of the joystick; and lighting at least a portion of the plurality of light sources to show the movement of the boat in the direction corresponding to the operation of the joystick.

22. The method according to claim 15, wherein the plurality of light sources are provided on a rear surface of the outboard motor.

* * * * *